US011421542B2

(12) United States Patent
Clark et al.

(10) Patent No.: US 11,421,542 B2
(45) Date of Patent: Aug. 23, 2022

(54) STATOR VANE RING OR RING SEGMENT

(71) Applicant: ROLLS-ROYCE plc, London (GB)

(72) Inventors: Christopher J. Clark, Cambridge (GB); John P. Longley, Cambridge (GB); Heather K. Jameson, Cambridge (GB); Frederic B. Goenaga, Bristol (GB)

(73) Assignee: ROLLS-ROYCE PLC, London (GB)

( * ) Notice: Subject to any disclaimer, the term of this patent is extended or adjusted under 35 U.S.C. 154(b) by 0 days.

(21) Appl. No.: 17/009,222

(22) Filed: Sep. 1, 2020

(65) Prior Publication Data

US 2021/0087940 A1 Mar. 25, 2021

(30) Foreign Application Priority Data

Sep. 24, 2019 (GB) ..... 1913728

(51) Int. Cl.
*F01D 9/04* (2006.01)

(52) U.S. Cl.
CPC ..... *F01D 9/042* (2013.01); *F05D 2220/32* (2013.01); *F05D 2240/12* (2013.01); *F05D 2240/121* (2013.01); *F05D 2240/24* (2013.01); *F05D 2250/71* (2013.01)

(58) Field of Classification Search
CPC ..... F01D 9/00; F01D 9/02; F01D 9/04; F01D 9/041; F01D 9/042; F01D 5/12; F01D 5/14; F01D 5/141; F01D 5/142; F05D 2240/12; F05D 2240/121; F05D 2240/122; F05D 2240/123; F05D 2240/124; F05D 2240/125; F05D 2240/24; F05D 2240/303; F05D 2240/304; F05D 2240/305; F05D 2240/306; F05D 2240/307; F05D 2220/32; F05D 2250/71
USPC ..... 416/5
See application file for complete search history.

(56) References Cited

U.S. PATENT DOCUMENTS

| | | | | |
|---|---|---|---|---|
| 5,063,662 | A | 11/1991 | Porter et al. | |
| 5,269,058 | A | 12/1993 | Wiggs et al. | |
| 8,864,457 | B2 | 10/2014 | Malandra et al. | |
| 9,797,267 | B2 | 10/2017 | Louhaus et al. | |
| 2011/0280735 | A1* | 11/2011 | Dakowski | F01D 5/082 416/97 R |
| 2016/0177723 | A1* | 6/2016 | Lohaus | F01D 5/141 415/199.5 |

FOREIGN PATENT DOCUMENTS

| | | |
|---|---|---|
| GB | 2164098 | 3/1986 |
| WO | 2015054023 A | 4/2015 |

OTHER PUBLICATIONS

European Search report dated Nov. 6, 2020, issued in EP Patent Application No. 20193780.2.
Great Britain search report dated Feb. 27, 2020, issued in GB Patent Application No. 1913728.0.

* cited by examiner

*Primary Examiner* — Eldon T Brockman
*Assistant Examiner* — Elton K Wong
(74) *Attorney, Agent, or Firm* — Barnes & Thornburg LLP; John Thomas Routon

(57) ABSTRACT

There is disclosed a turbine comprising a stator vane ring 122 downstream of a rotor ring 116 of shrouded rotor blades 118. In vanes of the stator vane ring, an upstream portion of a mean camber line 136 diverges from a profile of the mean camber line at a half-span location, particularly to receive a tip leakage flow over the shrouded rotor blades 118.

15 Claims, 9 Drawing Sheets

STATOR VANE RING OR RING SEGMENT

CROSS-REFERENCE TO RELATED APPLICATIONS

This specification is based upon and claims the benefit of priority from UK Patent Application Number 1913728.0 filed on 24 Sep. 2019, the entire contents of which are incorporated herein by reference.

BACKGROUND

Technical Field

The invention relates to a stator vane ring or ring segment for a turbine of a gas turbine engine.

Description of the Related Art

A turbine of a gas turbine engine has a succession of turbine stages, each stage comprising a ring of stator vanes which accelerate and expand the flow, followed by a ring of turbine blades which are driven to rotate by the kinetic energy of the flow. Stator vanes typically turn the flow away from the axial flow direction through the turbine so as to achieve a high rotational speed of the turbine blades.

The turbine rotor blades have the effect of turning the flow towards the axial direction. However, since the turbine blades pass both upstream and downstream stator vanes as they rotate, the flow regimes at the inlet and outlet of the passages between adjacent turbine blades is inherently highly unsteady. Accordingly, stator vanes downstream of a ring of turbine blades receive an unsteady inlet flow in which the inlet flow angle is highly variable. Consequently, stator vanes tend to be designed with a relatively large radius leading edge, leading to a relatively thick upstream portion of the vane which accommodates a broad range of flow inlet angles without adverse flow separation.

SUMMARY

According to a first aspect there is provided a turbine for a gas turbine engine, comprising:

a rotor ring comprising a plurality of shrouded rotor blades configured to rotate about a turbine centreline axis and to permit a tip leakage flow between respective shrouds and a casing; and a stator vane ring disposed downstream of the rotor ring so as to receive the tip leakage flow, the stator vane ring comprising a plurality of vanes;

wherein each vane of the plurality defines a continuum of aerofoil sections so along a span of the vane, the aerofoil section at any spanwise location being a locus of points on a surface of the vane that share a common value of normalized span, wherein the span of the aerofoil is variable along the turbine centreline axis;

wherein each aerofoil section defines a mean camber line extending from a leading edge point to a trailing edge point, the leading edge point being a point of maximum curvature towards an upstream end of the vane, the trailing edge point being a point of maximum curvature towards a downstream end of the vane;

wherein each aerofoil section has a variable camber angle along the mean camber line, defined for any camber line point on the mean camber line as an angle between a respective tangent of the mean camber line and an orthogonal projection of the tangent onto a plane intersecting both the turbine centreline axis and the respective camber line point, wherein the camber angle at the leading edge point is the leading edge camber angle ($X_{LE}$) and the camber angle at the trailing edge point is the trailing edge camber angle ($X_{TE}$);

wherein each of the plurality of vanes is curved so that at a half-span location along the vane, the leading edge camber angle ($X_{LE}$) and the trailing edge camber angle ($X_{TE}$) are of opposite sign;

wherein the sign convention for the camber angle at any spanwise location along the vane is such that, at the half-span location, the camber angle increases along the mean camber line from a negative leading edge camber angle ($X_{LE}$) to a positive trailing edge camber angle ($X_{TE}$);

wherein, towards a radially-outer tip of each vane, an upstream portion of the mean camber line diverges from a profile of the mean camber line at the half-span location so that within a tip portion of the vane the leading edge camber angle ($X_{LE}$) is positive.

As described in further detail herein, a negative leading edge camber angle along a turbine vane is conventionally provided to accommodate an expected range of flow angles coming from an upstream rotor ring, whereas the present disclosure proposes the use of a diverging profile of an upstream portion of the mean camber line towards a radially-outer tip of each vane, so that in a tip portion of the vane the leading edge camber angle is positive. By making the leading edge camber angle positive, the tip portion of the vane is better aligned with a leakage flow from the upstream shrouded rotor ring that is not significantly turned by the turbine blades. The inventors have determined that such a leakage flow has a substantially constant range of flow angles which is significantly different to the range of flow angles experienced along the rest of the blade.

The span of a vane as referred to herein is the radial distance between a radially-inner platform and a radially outer platform between which the vane extends (i.e. the distance along a radial axis orthogonal to the turbine centreline axis). The span is variable along the turbine centreline axis to reflect that the profile of the radially-inner and radially-outer platforms may not be coaxial, but instead may converge or more typically diverge from one another. Accordingly, a notional surface of constant normalized span is an axisymmetric surface about the turbine centreline axis, and a locus of points on a surface of a vane that share a common value of normalized span lie on such an axisymmetric surface. It will be appreciated that some vane geometries lean (e.g. such that they are further forward along the turbine centreline axis towards the radially-outer tip than at the radially-inner root of the vane, or vice versa) and/or twist, such that some radial planes (i.e. planes normal to the turbine centreline axis) only intersect one portion or end of the vane. Accordingly, by defining the span as varying between the radially-inner and radially-outer platforms associated with the stator vane ring, the skilled person can readily define span as a function of axial location and determine surfaces and aerofoil sections at constant normalized values of span. As used herein, the term spanwise inherently relates to the radial direction, but indicates a radial extent which may vary as a function of axial position. For example, a spanwise portion of a vane between 0.5 span and 0.6 span may be delimited by axisymmetric radially-inner and radially-outer surfaces that are non-cylindrical. It should be noted that the term "aerofoil" inherently denotes a cross-sectional shape (profile).

Where there is a curve of constant maximum curvature towards the upstream or downstream end of the vane, the leading edge point or the trailing edge point respectively is defined as the mid-point along that curve.

Each vane may comprise an intermediate portion having a spanwise extent from the half-span location to the radially-inner boundary of the tip portion (i.e. terminating at the radially-inner boundary of the tip portion). For example, when the tip portion of each vane has a spanwise extent of 0.05 span from the tip of the vane, then the intermediate portion terminates at 0.95 span, and when the tip portion of each vane has a spanwise extent of 0.2 from the tip of the vane, then the intermediate portion terminates at 0.98 span.

It may be that a camber angle requirement specified as being satisfied within the tip portion is not satisfied throughout the intermediate portion.

The leading edge camber angle may be negative in the intermediate portion.

It may be that, in any aerofoil section within the tip portion of each vane, an angular difference between the leading edge camber angle and the trailing edge camber angle is 70° or less.

In aerofoil sections within the intermediate portion, an angular difference between the leading edge camber angle and the trailing edge camber angle may be greater than 70° in the intermediate portion.

The angular difference may be no more than 60°, or no more than 50° in the tip portion, and more than 60°, or more than 50° respectively, in the intermediate portion.

It may be that, in any aerofoil section within the tip portion of each vane, an angular difference between the leading edge camber angle and the trailing edge camber angle is no more than 75% of the angular difference between the leading edge camber angle and the trailing edge camber angle at the half-span location.

In aerofoil sections within the intermediate portion, an angular difference between the leading edge camber angle and the trailing edge camber angle may be more than 75% of the angular difference between the leading edge camber angle and the trailing edge camber angle at the half-span location.

The angular difference may be no more than 60%, or no more than 50% in the tip portion; and more than 60%, or more than 50% respectively, in the intermediate portion.

By providing a lower angular difference in the tip portion, the leading edge camber angle in the tip region varies significantly from the leading edge camber angle at the half-span location, whereas the trailing edge camber angle may be similar in the tip portion as at the half-span location. Consequently, the outlet flow angle along the span of the vane can be optimised for the downstream rotor ring, irrespective of any diverging profile of an upstream portion of the mean camber line towards the tip as described above.

It may be that, for any aerofoil section within the tip portion of each vane, an angular difference between the respective leading edge camber angle and the leading edge camber angle at the half-span location of the respective vane is at least 30°.

For aerofoil sections within the intermediate portion, an angular difference between the respective leading edge camber angle and the leading edge camber angle at the half-span location may be less than 30°.

The angular difference may be at least 45° in the tip portion, and the angular difference may be less than 45° in the intermediate portion.

A significant angular difference between the leading edge camber angle at the half-span location and within the tip portion reflects a significant variation in the range of flow angles at respective spanwise locations of the vane, and a correspondingly significant performance improvement in aligning the tip portion of the vane with the leakage flow as compared with a vane of substantially constant profile along its span.

It may be that each vane comprises a spanwise transition portion along which the leading edge camber angle increases towards the tip of the vane, and wherein a rate of change of the leading edge camber angle per 0.01 span of the vane, within the transition portion, is at least 3°.

Since the spanwise extent of a shroud leakage flow is relatively small, an optimum leading edge camber angle may vary relatively abruptly towards the tip of the blade. Accordingly, a rate of change of the leading edge camber angle which is commensurately high per unit span may enable the geometry to approximate the optimum leading edge camber angle for the local flow conditions.

The spanwise extent of the transition portion may be contiguous with the tip portion (i.e. terminating at the radially-inner boundary of the tip portion), or may overlap with the tip portion. The spanwise extent of the transition portion may overlap with the intermediate portion, or may be within the intermediate portion and coterminous with the intermediate portion.

It may be that each vane comprises a spanwise transition portion along which the leading edge camber angle increases towards the tip of the vane, and wherein a rate of change of the leading edge camber angle per 0.01 span of the vane, within the transition portion, is at least:

$$0.03\times|\chi_{half\text{-}span,TE}-\chi_{half\text{-}span,LE}|$$

wherein $\chi_{half\text{-}span}$ is the camber angle at the half-span location, and TE, LE denote the camber angle at the trailing edge and leading edge respectively.

It may be that, each aerofoil section defines a turning angle defined as the difference between the trailing edge camber angle and the leading edge camber angle ($\chi_{TE}-\chi_{LE}$), wherein the sign convention for the turning angle is such that the turning angle is positive at the half-span location; and wherein each vane comprises a spanwise transition portion along which the turning angle reduces towards the tip of the vane, and wherein a rate of change of the turning angle per 0.01 span of the vane, towards the tip of the vane and within the transition portion, is less than −3°. For example, the rate of change may be −4° or −5° per 0.01 span.

It may be that, in each vane, the spanwise extent of the transition portion is at least 0.02 of the span of the vane, and wherein the leading edge camber angle varies continuously within with the transition portion. The transition portion may have a spanwise extent of at least 0.03 of the span of the vane, for example at least 0.05 of the span of the vane, at least 0.1 of the span of the vane or at least 0.15 of the span of the vane.

The definition that the camber angle varies continuously is intended to mean that the leading edge camber angle varies such that there are no discontinuous changes (e.g. step changes) in the leading edge camber angle along the spanwise extent of the transition portion.

By having a transition portion of a minimum spanwise extent as specified above, a significant variation in the leading edge camber angle may be effected gradually rather than abruptly, which may have disadvantageous aerodynamic effects.

It may be that the rate of change of the leading edge camber angle per 0.01 span of the vane is at least 3° throughout the transition portion. The rate of change of the leading edge camber angle per 0.01 span of the vane may be at least 5° throughout the transition portion, for example at least 7° throughout the transition portion.

It may be that the rate of change of the leading edge camber angle per 0.01 span of the vane is at least $$0.03\times|\chi_{half\text{-}span,TE}-\chi_{half\text{-}span,LE}|$$

throughout the transition portion, wherein $\chi_{half\text{-}span}$ is the camber angle at the half-span location, and TE, LE denote the camber angle at the trailing edge and leading edge respectively. The rate of change of the leading edge camber angle per 0.01 span of the vane may be at least 0.05×, for example at least 0.07× multiple of the turning angle at the half span location.

When the transition portion is at least 0.03 as specified above, it may be that the rate of change of the turning angle per 0.01 span of the vane, towards the tip of the vane and throughout the transition portion, is less than −3°. The rate of change may be −5° or less, for examples −7° or less, throughout the transition portion.

By having a minimum rate of change throughout the transition portion, the spanwise extent of the transition portion may be minimised while achieving a significant total variation in the leading edge camber angle.

It may be that the leading edge camber angle varies by at least 30° within the transition portion. The leading edge camber angle may vary by at least 45° within the transition portion.

It may be that the tip portion of each vane has a spanwise extent from the tip of the vane of at least 0.01 span and no more than 0.15 span, for example between 0.03 span and 0.1 span.

It may be that the rotor ring is one of a plurality of rotor rings of the turbine, and wherein the stator vane ring is one of a plurality of stator vane rings of the turbine, each being downstream of a respective rotor ring.

Each stator vane ring may have any of the features of the stator vane ring described above with respect to the first aspect of the invention.

According to a second aspect there is provided a gas turbine engine comprising at least a first shaft and one or more further shafts, a high pressure turbine having one or more rotor rings coupled to the first shaft, and one or more lower pressure turbines downstream of the high pressure turbine, wherein at least one of the lower pressure turbines is in accordance with the first aspect and has one so or more rotor rings coupled to a respective one of the further shafts.

According to a third aspect there is provided a stator vane ring segment or stator vane ring for a turbine for a gas turbine engine, comprising a plurality of stator vanes angularly arranged around a turbine centreline axis;

wherein each vane of the plurality defines a continuum of aerofoil sections along a span of the vane, the aerofoil section at any spanwise location being a locus of points on a surface of the aerofoil that share a common value of normalized span, wherein the span of the aerofoil is variable along the turbine centreline axis;

wherein each aerofoil section defines a mean camber line extending from a leading edge point to a trailing edge point, the leading edge point being a point of maximum curvature towards an upstream end of the vane, the trailing edge point being a point of maximum curvature towards a downstream end of the vane;

wherein each aerofoil section has a variable camber angle along the mean camber line, defined for any camber line point on the mean camber line as an angle between a respective tangent of the mean camber line and an orthogonal projection of the tangent onto a plane intersecting both the turbine centreline axis and the respective camber line point, wherein the camber angle at the leading edge point is the leading edge camber angle ($X_{LE}$) and the camber angle at the trailing edge point is the trailing edge camber angle ($X_{TE}$);

wherein each of the plurality of vanes is curved so that at a half-span location along the vane, the leading edge camber angle and the trailing edge camber angle are of opposite sign;

wherein the sign convention for the camber angle at any spanwise location along the vane is such that, at the half-span location, the camber angle increases along the mean camber line from a negative leading edge camber angle to a positive trailing edge camber angle;

wherein, towards a radially-outer tip of each vane, an upstream portion of the mean camber line diverges from a profile of the mean camber line at the half-span location so that within a tip portion of the vane the leading edge camber angle is positive.

The vanes of the stator vane ring segment or stator vane ring may have any of the features described above with respect to the first aspect of the invention.

As noted elsewhere herein, the present disclosure may relate to a gas turbine engine. Such a gas turbine engine may comprise an engine core comprising a turbine, a combustor, a compressor, and a core shaft connecting the turbine to the compressor. Such a gas turbine engine may comprise a fan (having fan blades) located upstream of the engine core.

Arrangements of the present disclosure may be particularly, although not exclusively, beneficial for fans that are driven via a gearbox. Accordingly, the gas turbine engine may comprise a gearbox that receives an input from the core shaft and outputs drive to the fan so as to drive the fan at a lower rotational speed than the core shaft. The input to the gearbox may be directly from the core shaft, or indirectly from the core shaft, for example via a spur shaft and/or gear. The core shaft may rigidly connect the turbine and the compressor, such that the turbine and compressor rotate at the same speed (with the fan rotating at a lower speed).

The gas turbine engine as described and/or claimed herein may have any suitable general architecture. For example, the gas turbine engine may have any desired number of shafts that connect turbines and compressors, for example one, two or three shafts. Purely by way of example, the turbine connected to the core shaft may be a first turbine, the compressor connected to the core shaft may be a first compressor, and the core shaft may be a first core shaft. The engine core may further comprise a second turbine, a second compressor, and a second core shaft connecting the second turbine to the second compressor. The second turbine, second compressor, and second core shaft may be arranged to rotate at a higher rotational speed than the first core shaft.

In such an arrangement, the second compressor may be positioned axially downstream of the first compressor. The second compressor may be arranged to receive (for example directly receive, for example via a generally annular duct) flow from the first compressor.

The gearbox may be arranged to be driven by the core shaft that is configured to rotate (for example in use) at the lowest rotational speed (for example the first core shaft in the example above). For example, the gearbox may be arranged to be driven only by the core shaft that is configured to rotate (for example in use) at the lowest rotational speed (for example only be the first core shaft, and not the second core shaft, in the example above). Alternatively, the gearbox may be arranged to be driven by any one or more shafts, for example the first and/or second shafts in the example above.

The gearbox may be a reduction gearbox (in that the output to the fan is a lower rotational rate than the input from the core shaft). Any type of gearbox may be used. For example, the gearbox may be a "planetary" or "star" gearbox, as described in more detail elsewhere herein. The gearbox may have any desired reduction ratio (defined as the rotational speed of the input shaft divided by the rotational speed of the output shaft), for example greater than 2.5, for example in the range of from 3 to 4.2, or 3.2 to 3.8, for example on the order of or at least 3, 3.1, 3.2, 3.3, 3.4, 3.5, 3.6, 3.7, 3.8, 3.9, 4, 4.1 or 4.2. The gear ratio may be, for example, between any two of the values in the previous sentence. Purely by way of example, the gearbox may be a "star" gearbox having a ratio in the range of from 3.1 or 3.2 to 3.8. In some arrangements, the gear ratio may be outside these ranges.

In any gas turbine engine as described and/or claimed herein, a combustor may be provided axially downstream of the fan and compressor(s). For example, the combustor may be directly downstream of (for example at the exit of) the second compressor, where a second compressor is provided. By way of further example, the flow at the exit to the combustor may be provided to the inlet of the second turbine, where a second turbine is provided. The combustor may be provided upstream of the turbine(s).

The or each compressor (for example the first compressor and second compressor as described above) may comprise any number of stages, for example multiple stages. Each stage may comprise a row of rotor blades and a row of stator vanes, which may be variable stator vanes (in that their angle of incidence may be variable). The row of rotor blades and the row of stator vanes may be axially offset from each other.

The or each turbine (for example the first turbine and second turbine as described above) may comprise any number of stages, for example multiple stages. Each stage may comprise a row of rotor blades and a row of stator vanes. The row of rotor blades and the row of stator vanes may be axially offset from each other. Each fan blade may be defined as having a radial span extending from a root (or hub) at a radially inner gas-washed location, or 0% span position, to a tip at a 100% span position. The ratio of the radius of the fan blade at the hub to the radius of the fan blade at the tip may be less than (or on the order of) any of: 0.4, 0.39, 0.38 0.37, 0.36, 0.35, 0.34, 0.33, 0.32, 0.31, 0.3, 0.29, 0.28, 0.27, 0.26, or 0.25. The ratio of the radius of the fan blade at the hub to the radius of the fan blade at the tip may be in an inclusive range bounded by any two of the values in the previous sentence (i.e. the values may form upper or lower bounds), for example in the range of from 0.28 to 0.32. These ratios may commonly be referred to as the hub-to-tip ratio. The radius at the hub and the radius at the tip may both be measured at the leading edge (or axially forwardmost) part of the blade. The hub-to-tip ratio refers, of course, to the gas-washed portion of the fan blade, i.e. the portion radially outside any platform. The radius of the fan may be measured between the engine centreline and the tip of a fan blade at its leading edge. The fan diameter (which may simply be twice the radius of the fan) may be greater than (or on the order of) any of: 220 cm, 230 cm, 240 cm, 250 cm (around 100 inches), 260 cm, 270 cm (around 105 inches), 280 cm (around 110 inches), 290 cm (around 115 inches), 300 cm (around 120 inches), 310 cm, 320 cm (around 125 inches), 330 cm (around 130 inches), 340 cm (around 135 inches), 350 cm, 360 cm (around 140 inches), 370 cm (around 145 inches), 380 (around 150 inches) cm, 390 cm (around 155 inches), 400 cm, 410 cm (around 160 inches) or 420 cm (around 165 inches). The fan diameter may be in an inclusive range bounded by any two of the values in the previous sentence (i.e. the values may form upper or lower bounds), for example in the range of from 240 cm to 280 cm or 330 cm to 380 cm.

The rotational speed of the fan may vary in use. Generally, the rotational speed is lower for fans with a higher diameter. Purely by way of non-limitative example, the rotational speed of the fan at cruise conditions may be less than 2500 rpm, for example less than 2300 rpm. Purely by way of further non-limitative example, the rotational speed of the fan at cruise conditions for an engine having a fan diameter in the range of from 220 cm to 300 cm (for example 240 cm to 280 cm or 250 cm to 270 cm) may be in the range of from 1700 rpm to 2500 rpm, for example in the range of from 1800 rpm to 2300 rpm, for example in the range of from 1900 rpm to 2100 rpm. Purely by way of further non-limitative example, the rotational speed of the fan at cruise conditions for an engine having a fan diameter in the range of from 330 cm to 380 cm may be in the range of from 1200 rpm to 2000 rpm, for example in the range of from 1300 rpm to 1800 rpm, for example in the range of from 1400 rpm to 1800 rpm.

In use of the gas turbine engine, the fan (with associated fan blades) rotates about a rotational axis. This rotation results in the tip of the fan blade moving with a velocity $U_{tip}$. The work done by the fan blades 13 on the flow results in an enthalpy rise dH of the flow. A fan tip loading may be defined as $dH/U_{tip}^2$, where dH is the enthalpy rise (for example the 1-D average enthalpy rise) across the fan and $U_{tip}$ is the (translational) velocity of the fan tip, for example at the leading edge of the tip (which may be defined as fan tip radius at leading edge multiplied by angular speed). The fan tip loading at cruise conditions may be greater than (or on the order of) any of: 0.28, 0.29, 0.30, 0.31, 0.32, 0.33, 0.34, 0.35, 0.36, 0.37, 0.38, 0.39 or 0.4 (all values being dimensionless). The fan tip loading may be in an inclusive range bounded by any two of the values in the previous sentence (i.e. the values may form upper or lower bounds), for example in the range of from 0.28 to 0.31, or 0.29 to 0.3.

Gas turbine engines in accordance with the present disclosure may have any desired bypass ratio, where the bypass ratio is defined as the ratio of the mass flow rate of the flow through the bypass duct to the mass flow rate of the flow through the core at cruise conditions. In some arrangements the bypass ratio may be greater than (or on the order of) any of the following: 10, 10.5, 11, 11.5, 12, 12.5, 13, 13.5, 14, 14.5, 15, 15.5, 16, 16.5, 17, 17.5, 18, 18.5, 19, 19.5 or 20. The bypass ratio may be in an inclusive range bounded by any two of the values in the previous sentence (i.e. the values may form upper or lower bounds), for example in the range of form 12 to 16, 13 to 15, or 13 to 14. The bypass duct may be substantially annular. The bypass duct may be radially outside the engine core. The radially outer surface of the bypass duct may be defined by a nacelle and/or a fan case.

The overall pressure ratio of a gas turbine engine as described and/or claimed herein may be defined as the ratio of the stagnation pressure upstream of the fan to the stagnation pressure at the exit of the highest pressure compressor (before entry into the combustor). By way of non-limitative example, the overall pressure ratio of a gas turbine engine as described and/or claimed herein at cruise may be greater than (or on the order of) any of the following: 35, 40, 45, 50, 55, 60, 65, 70, 75. The overall pressure ratio may be in an inclusive range bounded by any two of the values in the previous sentence (i.e. the values may form upper or lower bounds), for example in the range of from 50 to 70.

Specific thrust of an engine may be defined as the net thrust of the engine divided by the total mass flow through the engine. At cruise conditions, the specific thrust of an engine described and/or claimed herein may be less than (or on the order of) any of the following: 110 $Nkg^{-1}s$, 105 $Nkg^{-1}s$, 100 $Nkg^{-1}s$, 95 $Nkg^{-1}s$, 90 $Nkg^{-1}s$, 85 $Nkg^{-1}s$ or 80 $Nkg^{-1}s$. The specific thrust may be in an inclusive range bounded by any two of the values in the previous sentence (i.e. the values may form upper or lower bounds), for example in the range of from 80 $Nkg^{-1}s$ to 100 $Nkg^{-1}s$, or 85 $Nkg^{-1}s$ to 95 $Nkg^{-1}s$. Such engines may be particularly efficient in comparison with conventional gas turbine engines.

A gas turbine engine as described and/or claimed herein may have any desired maximum thrust. Purely by way of non-limitative example, a gas turbine as described and/or claimed herein may be capable of producing a maximum thrust of at least (or on the order of) any of the following: 160 kN, 170 kN, 180 kN, 190 kN, 200 kN, 250 kN, 300 kN, 350 kN, 400 kN, 450 kN, 500 kN, or 550 kN. The maximum thrust may be in an inclusive range bounded by any two of the values in the previous sentence (i.e. the values may form upper or lower bounds). Purely by way of example, a gas turbine as described and/or claimed herein may be capable of producing a maximum thrust in the range of from 330 kN to 420 kN, for example 350 kN to 400 kN. The thrust referred to above may be the maximum net thrust at standard atmospheric conditions at sea level plus 15 degrees C. (ambient pressure 101.3 kPa, temperature 30 degrees C.), with the engine static.

In use, the temperature of the flow at the entry to the high pressure turbine may be particularly high. This temperature, which may be referred to as TET, may be measured at the exit to the combustor, for example immediately upstream of the first turbine vane, which itself may be referred to as a nozzle guide vane. At cruise, the TET may be at least (or on the order of) any of the following: 1400K, 1450K, 1500K, 1550K, 1600K or 1650K. The TET at cruise may be in an inclusive range bounded by any two of the values in the previous sentence (i.e. the values may form upper or lower bounds). The maximum TET in use of the engine may be, for example, at least (or on the order of) any of the following: 1700K, 1750K, 1800K, 1850K, 1900K, 1950K or 2000K. The maximum TET may be in an inclusive range bounded by any two of the values in the previous sentence (i.e. the values may form upper or lower bounds), for example in the range of from 1800K to 1950K. The maximum TET may occur, for example, at a high thrust condition, for example at a maximum take-off (MTO) condition.

A fan blade and/or aerofoil portion of a fan blade described and/or claimed herein may be manufactured from any suitable material or combination of materials. For example at least a part of the fan blade and/or aerofoil may be manufactured at least in part from a composite, for example a metal matrix composite and/or an organic matrix composite, such as carbon fibre. By way of further example at least a part of the fan blade and/or aerofoil may be manufactured at least in part from a metal, such as a titanium based metal or an aluminium based material (such as an aluminium-lithium alloy) or a steel based material. The fan blade may comprise at least two regions manufactured using different materials. For example, the fan blade may have a protective leading edge, which may be manufactured using a material that is better able to resist impact (for example from birds, ice or other material) than the rest of the blade. Such a leading edge may, for example, be manufactured using titanium or a titanium-based alloy. Thus, purely by way of example, the fan blade may have a carbon-fibre or aluminium based body (such as an aluminium lithium alloy) with a titanium leading edge.

A fan as described and/or claimed herein may comprise a central portion, from which the fan blades may extend, for example in a radial direction. The fan blades may be attached to the central portion in any desired manner. For example, each fan blade may comprise a fixture which may engage a corresponding slot in the hub (or disc). Purely by way of example, such a fixture may be in the form of a dovetail that may slot into and/or engage a corresponding slot in the hub/disc in order to fix the fan blade to the hub/disc. By way of further example, the fan blades maybe formed integrally with a central portion. Such an arrangement may be referred to as a bladed disc or a bladed ring. Any suitable method may be used to manufacture such a bladed disc or bladed ring. For example, at least a part of the fan blades may be machined from a block and/or at least part of the fan blades may be attached to the hub/disc by welding, such as linear friction welding.

The gas turbine engines described and/or claimed herein may or may not be provided with a variable area nozzle (VAN). Such a variable area nozzle may allow the exit area of the bypass duct to be varied in use. The general principles of the present disclosure may apply to engines with or without a VAN.

The fan of a gas turbine as described and/or claimed herein may have any desired number of fan blades, for example 14, 16, 18, 20, 22, 24 or 26 fan blades.

As used herein, cruise conditions have the conventional meaning and would be readily understood by the skilled person. Thus, for a given gas turbine engine for an aircraft, the skilled person would immediately recognise cruise conditions to mean the operating point of the engine at mid-cruise of a given mission (which may be referred to in the industry as the "economic mission") of an aircraft to which the gas turbine engine is designed to be attached. In this regard, mid-cruise is the point in an aircraft flight cycle at which 50% of the total fuel that is burned between top of climb and start of descent has been burned (which may be approximated by the midpoint—in terms of time and/or distance—between top of climb and start of descent. Cruise conditions thus define an operating point of, the gas turbine engine that provides a thrust that would ensure steady state operation (i.e. maintaining a constant altitude and constant Mach Number) at mid-cruise of an aircraft to which it is designed to be attached, taking into account the number of engines provided to that aircraft. For example where an engine is designed to be attached to an aircraft that has two engines of the same type, at cruise conditions the engine provides half of the total thrust that would be required for steady state operation of that aircraft at mid-cruise.

In other words, for a given gas turbine engine for an aircraft, cruise conditions are defined as the operating point of the engine that provides a specified thrust (required to provide—in combination with any other engines on the aircraft—steady state operation of the aircraft to which it is designed to be attached at a given mid-cruise Mach Number) at the mid-cruise atmospheric conditions (defined by the International Standard Atmosphere according to ISO 2533 at the mid-cruise altitude). For any given gas turbine engine for an aircraft, the mid-cruise thrust, atmospheric conditions and Mach Number are known, and thus the operating point of the engine at cruise conditions is clearly defined.

Purely by way of example, the forward speed at the cruise condition may be any point in the range of from Mach 0.7 to 0.9, for example 0.75 to 0.85, for example 0.76 to 0.84, for example 0.77 to 0.83, for example 0.78 to 0.82, for example 0.79 to 0.81, for example on the order of Mach 0.8, on the order of Mach 0.85 or in the range of from 0.8 to 0.85. Any single speed within these ranges may be part of the cruise condition. For some aircraft, the cruise conditions may be outside these ranges, for example below Mach 0.7 or above Mach 0.9.

Purely by way of example, the cruise conditions may correspond to standard atmospheric conditions (according to the International Standard Atmosphere, ISA) at an altitude that is in the range of from 10000 m to 15000 m, for example in the range of from 10000 m to 12000 m, for example in the range of from 10400 m to 11600 m (around 38000 ft), for example in the range of from 10500 m to 11500 m, for example in the range of from 10600 m to 11400 m, for example in the range of from 10700 m (around 35000 ft) to 11300 m, for example in the range of from 10800 m to 11200 m, for example in the range of from 10900 m to 11100 m, for example on the order of 11000 m. The cruise conditions may correspond to standard atmospheric conditions at any given altitude in these ranges.

Purely by way of example, the cruise conditions may correspond to an operating point of the engine that provides a known required thrust level (for example a value in the range of from 30 kN to 35 kN) at a forward Mach number of 0.8 and standard atmospheric conditions (according to the International Standard Atmosphere) at an altitude of 38000 ft (11582 m). Purely by way of further example, the cruise conditions may correspond to an operating point of the engine that provides a known required thrust level (for example a value in the range of from 50 kN to 65 kN) at a forward Mach number of 0.85 and standard atmospheric conditions (according to the International Standard Atmosphere) at an altitude of 35000 ft (10668 m).

In use, a gas turbine engine described and/or claimed herein may operate at the cruise conditions defined elsewhere herein. Such cruise conditions may be determined by the cruise conditions (for example the mid-cruise conditions) of an aircraft to which at least one (for example 2 or 4) gas turbine engine may be mounted in order to provide propulsive thrust.

According to an aspect, there is provided an aircraft comprising a gas turbine engine as described and/or claimed herein. The aircraft according to this aspect is the aircraft for which the gas turbine engine has been designed to be attached. Accordingly, the cruise conditions according to this aspect correspond to the mid-cruise of the aircraft, as defined elsewhere herein.

According to an aspect, there is provided a method of operating a gas turbine engine as described and/or claimed herein. The operation may be at the cruise conditions as defined elsewhere herein (for example in terms of the thrust, atmospheric conditions and Mach Number).

According to an aspect, there is provided a method of operating an aircraft comprising a gas turbine engine as described and/or claimed herein. The operation according to this aspect may include (or may be) operation at the mid-cruise of the aircraft, as defined elsewhere herein.

The skilled person will appreciate that except where mutually exclusive, a feature or parameter described in relation to any one of the above aspects may be applied to any other aspect. Furthermore, except where mutually exclusive, any feature or parameter described herein may be applied to any aspect and/or combined with any other feature or parameter described herein.

DESCRIPTION OF THE DRAWINGS

Embodiments will now be described by way of example only, with reference to the Figures, in which.

DETAILED DESCRIPTION

Aspects and embodiments of the present disclosure will now be discussed with reference to the accompanying figures. Further aspects and embodiments will be apparent to those skilled in the art.

Figure 1:
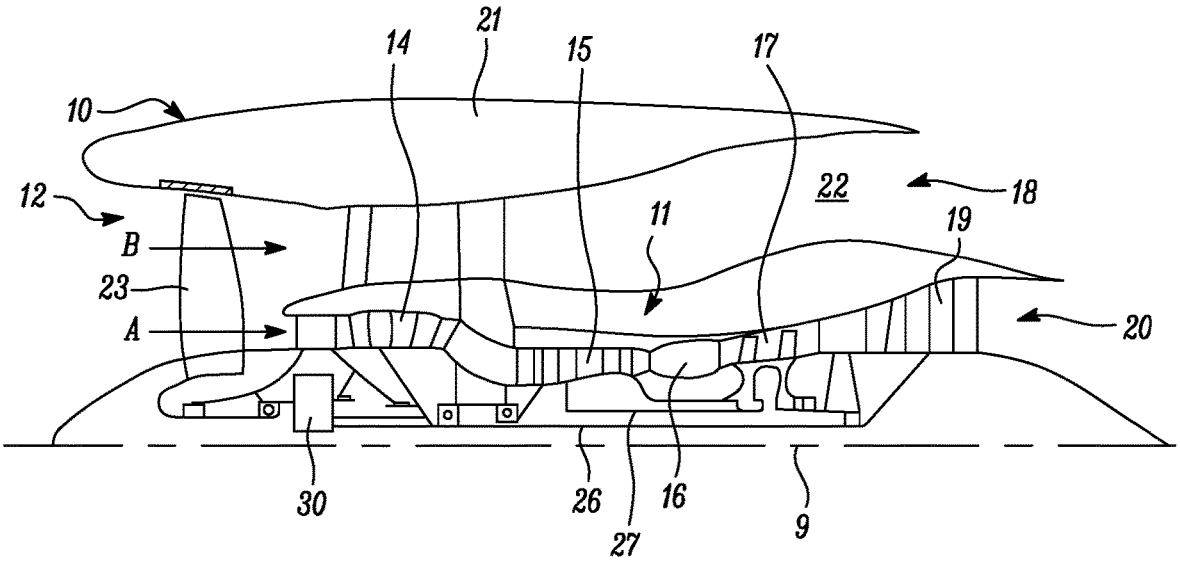
FIG. 1 is a sectional side view of a gas turbine engine.

FIG. 1 illustrates a gas turbine engine 10 having a principal rotational axis 9. The engine 10 comprises an air intake 12 and a propulsive fan 23 that generates two airflows: a core airflow A and a bypass airflow B. The gas turbine engine 10 comprises a core 11 that receives the core airflow A. The engine core 11 comprises, in axial flow series, a low pressure compressor 14, a high-pressure compressor 15, combustion equipment 16, a high-pressure turbine 17, a low pressure turbine 19 and a core exhaust nozzle 20. A nacelle 21 surrounds the gas turbine engine 10 and defines a bypass duct 22 and a bypass exhaust nozzle 18. The bypass airflow B flows through the bypass duct 22. The fan 23 is attached to and driven by the low pressure turbine 19 via a shaft 26 and an epicyclic gearbox 30.

In use, the core airflow A is accelerated and compressed by the low pressure compressor 14 and directed into the high pressure compressor 15 where further compression takes place. The compressed air exhausted from the high pressure compressor 15 is directed into the combustion equipment 16 where it is mixed with fuel and the mixture is combusted. The resultant hot combustion products then expand through, and thereby drive, the high pressure and low pressure turbines 17, 19 before being exhausted through the core exhaust nozzle 20 to provide some propulsive thrust. The high pressure turbine 17 drives the high pressure compressor 15 by a suitable interconnecting shaft 27. The fan 23 generally provides the majority of the propulsive thrust. The epicyclic gearbox 30 is a reduction gearbox.

Figure 2:
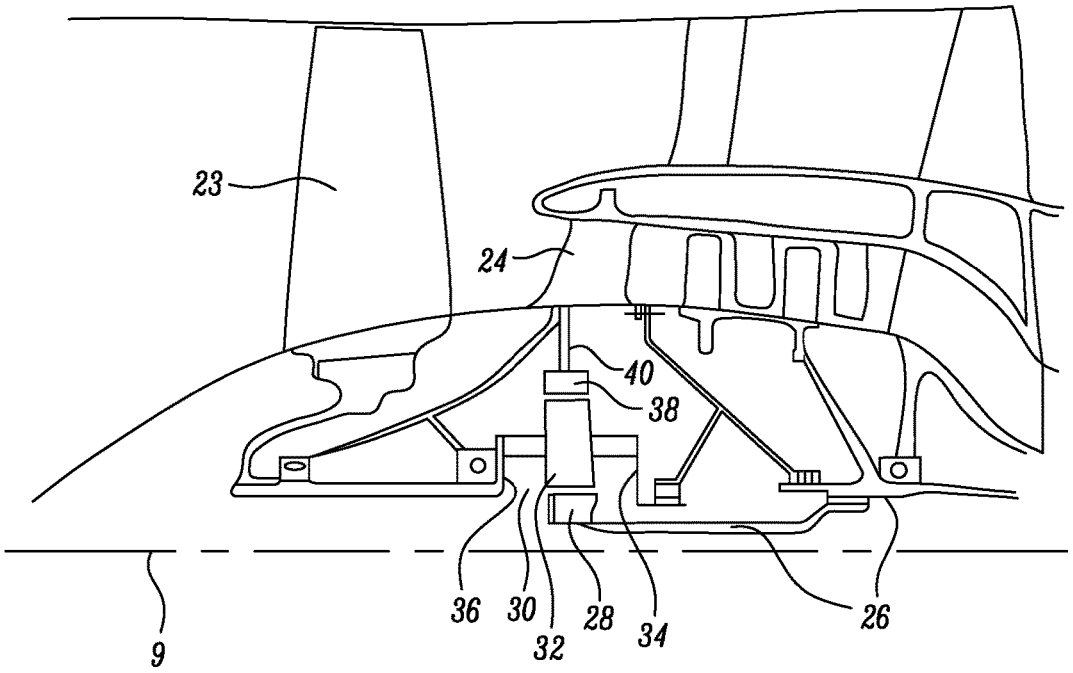
FIG. 2 is a close up sectional side view of an upstream portion of a gas turbine engine.

An exemplary arrangement for a geared fan gas turbine engine 10 is shown in FIG. 2. The low pressure turbine 19 (see FIG. 1) drives the shaft 26, which is coupled to a sun wheel, or sun gear, 28 of the epicyclic gear arrangement 30. Radially outwardly of the sun gear 28 and intermeshing therewith is a plurality of planet gears 32 that are coupled together by a planet carrier 34. The planet carrier 34 constrains the planet gears 32 to precess around the sun gear 28 in synchronicity whilst enabling each planet gear 32 to rotate about its own axis. The planet carrier 34 is coupled via linkages 36 to the fan 23 in order to drive its rotation about the engine axis 9. Radially outwardly of the planet gears 32 and intermeshing therewith is an annulus or ring gear 38 that is coupled, via linkages 40, to a stationary supporting structure 24.

Note that the terms "low pressure turbine" and "low pressure compressor" as used herein may be taken to mean the lowest pressure turbine stages and lowest pressure compressor stages (i.e. not including the fan 23) respectively and/or the turbine and compressor stages that are connected together by the interconnecting shaft 26 with the lowest rotational speed in the engine (i.e. not including the gearbox output shaft that drives the fan 23). In some literature, the "low pressure turbine" and "low pressure compressor" referred to herein may alternatively be known as the "intermediate pressure turbine" and "intermediate pressure compressor". Where such alternative nomenclature is used, the fan 23 may be referred to as a first, or lowest pressure, compression stage.

Figure 3:
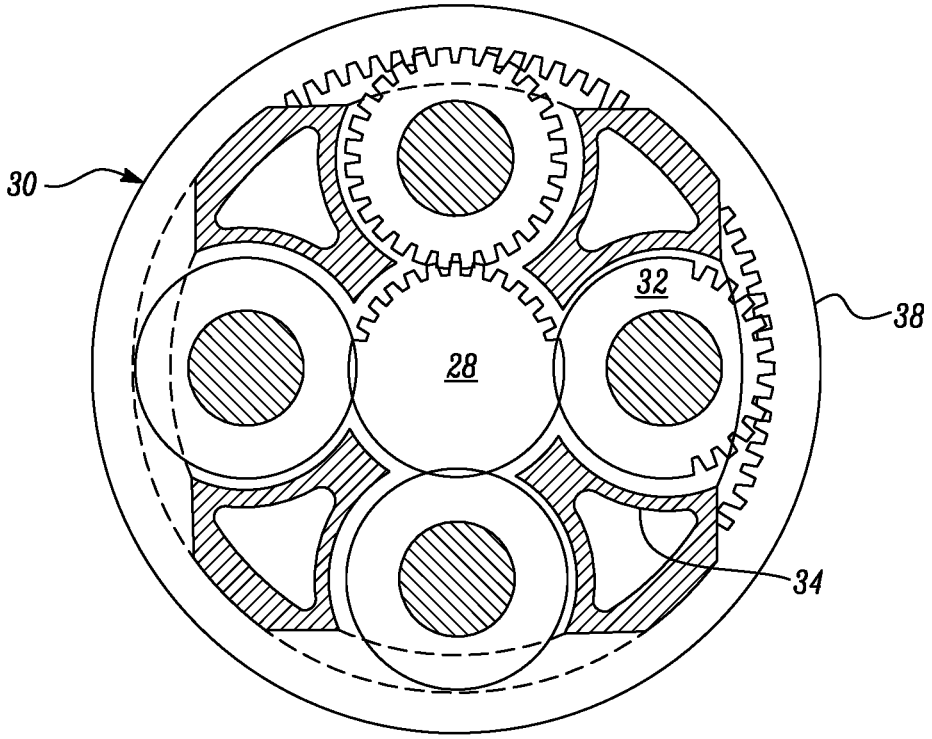
FIG. 3 is a partially cut-away view of a gearbox for a gas turbine engine.

The epicyclic gearbox 30 is shown by way of example in greater detail in FIG. 3. Each of the sun gear 28, planet gears 32 and ring gear 38 comprise teeth about their periphery to intermesh with the other gears. However, for clarity only exemplary portions of the teeth are illustrated in FIG. 3. There are four planet gears 32 illustrated, although it will be apparent to the skilled reader that more or fewer planet gears 32 may be provided within the scope of the claimed invention. Practical applications of a planetary epicyclic gearbox 30 generally comprise at least three planet gears 32.

The epicyclic gearbox 30 illustrated by way of example in FIGS. 2 and 3 is of the planetary type, in that the planet carrier 34 is coupled to an output shaft via linkages 36, with the ring gear 38 fixed. However, any other suitable type of epicyclic gearbox 30 may be used. By way of further example, the epicyclic gearbox 30 may be a star arrangement, in which the planet carrier 34 is held fixed, with the ring (or annulus) gear 38 allowed to rotate. In such an arrangement the fan 23 is driven by the ring gear 38. By way of further alternative example, the gearbox 30 may be a differential gearbox in which the ring gear 38 and the planet carrier 34 are both allowed to rotate.

It will be appreciated that the arrangement shown in FIGS. 2 and 3 is by way of example only, and various alternatives are within the scope of the present disclosure. Purely by way of example, any suitable arrangement may be used for locating the gearbox 30 in the engine 10 and/or for connecting the gearbox 30 to the engine 10. By way of further example, the connections (such as the linkages 36, 40 in the FIG. 2 example) between the gearbox 30 and other parts of the engine 10 (such as the input shaft 26, the output shaft and the fixed structure 24) may have any desired degree of stiffness or flexibility. By way of further example, any suitable arrangement of the bearings between rotating and stationary parts of the engine (for example between the input and output shafts from the gearbox and the fixed structures, such as the gearbox casing) may be used, and the disclosure is not limited to the exemplary arrangement of FIG. 2. For example, where the gearbox 30 has a star arrangement (described above), the skilled person would readily understand that the arrangement of output and support linkages and bearing locations would typically be different to that shown by way of example in FIG. 2.

Accordingly, the present disclosure extends to a gas turbine engine having any arrangement of gearbox styles (for example star or planetary), support structures, input and output shaft arrangement, and bearing locations.

Optionally, the gearbox may drive additional and/or alternative components (e.g. the intermediate pressure compressor and/or a booster compressor).

Other gas turbine engines to which the present disclosure may be applied may have alternative configurations. For example, such engines may have an alternative number of compressors and/or turbines and/or an alternative number of interconnecting shafts. By way of further example, the gas turbine engine shown in FIG. 1 has a split flow nozzle 18, 20 meaning that the flow through the bypass duct 22 has its own nozzle 18 that is separate to and radially outside the core exhaust nozzle 20. However, this is not limiting, and any aspect of the present disclosure may also apply to engines in which the flow through the bypass duct 22 and the flow through the core 11 are mixed, or combined, before (or upstream of) a single nozzle, which may be referred to as a mixed flow nozzle. One or both nozzles (whether mixed or split flow) may have a fixed or variable area. Whilst the described example relates to a turbofan engine, the disclosure may apply, for example, to any type of gas turbine engine, such as an open rotor (in which the fan stage is not surrounded by a nacelle) or turboprop engine, for example. In some arrangements, the gas turbine engine 10 may not comprise a gearbox 30.

The geometry of the gas turbine engine 10, and components thereof, is defined by a conventional axis system, comprising an axial direction (which is aligned with the rotational axis 9), a radial direction (in the bottom-to-top direction in FIG. 1), and a circumferential direction (perpendicular to the page in the FIG. 1 view). The axial, radial and circumferential directions are mutually perpendicular.

Figure 4:
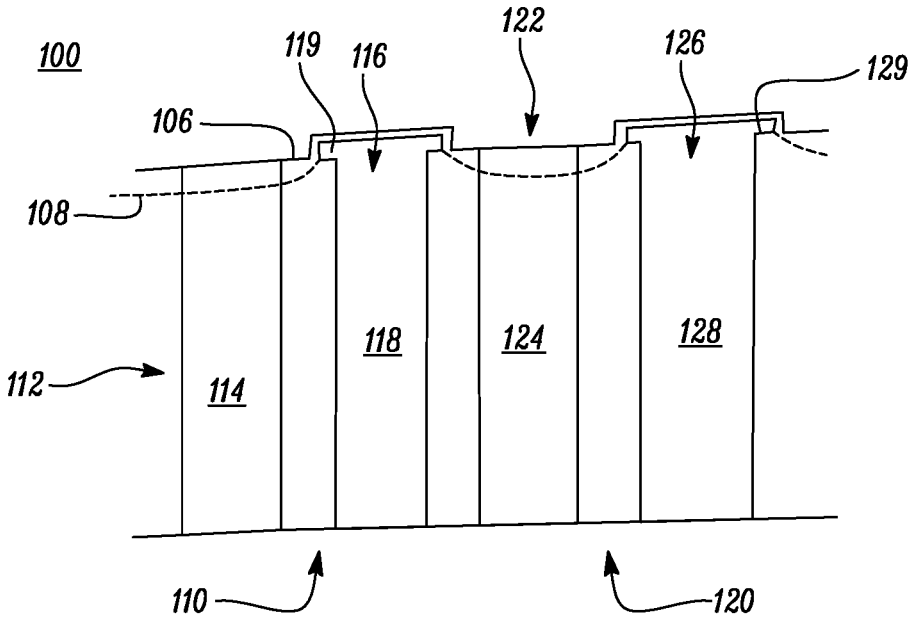
FIG. 4 is a schematic sectional view of two stages of an example turbine (axial and radial section)

FIG. 4 shows two stages 110, 120 of a turbine 100 of a gas turbine engine, such as the gas turbine engine 10 described above with reference to FIGS. 1-3. The two stages are representative of any two stages of the turbine, but in this example are both stages of a low pressure turbine within a three-shaft gas turbine engine.

Each stage 110, 120 comprises a stator vane ring 112, 122 comprising a plurality of stator vanes 114, 124 angularly arranged around a turbine centreline axis (which in this example is coincident with the principal rotation axis 9), and a rotor ring 116, 126 immediately downstream of the respective stator vane ring 112, 122 comprising a plurality of turbine blades 118, 128 angularly arranged around the turbine centreline axis and configured to rotate on a shaft coaxial with the turbine centreline axis.

The stator vanes 114, 124 and turbine blades 118, 128 each have a spanwise extent within an annular flow path through the turbine 100 which is bounded by radially inner and radially outer gas-washed surfaces. In this example, the radially-inner gas-washed surface is defined by radially inner platforms associated with the stator vanes 114, 124 and by radially inner platforms associated with the turbine blades 118, 128. In this example, the radially-outer gas-washed surface is defined by radially outer platforms associated with the stator vanes 114, 124 and by a radially-inner surface of shrouds 119, 129 provided at the tip of the turbine blades 118, 128.

The turbine 100 comprises a radially-outer casing 106 which surrounds the turbine blades 118, 128 with minimal clearance to inhibit excessive leakage around the turbine blades 118, 128. Nevertheless, the turbine blades 118, 128 are configured to rotate about the turbine centrelines axis 102 so as to permit a tip leakage flow between the shrouds 119, 129 and the casing 106, as indicated by streamline 108.

While it is acknowledged that stator vanes and turbine blades are typically provided integrally with supporting structures, the foregoing disclosure primarily relates to the aerodynamically functional portions of the stator vanes and turbine blades (i.e. those portions which define aerofoils in cross-section). Accordingly, while it may be typical for one or more stator vanes to be provided as an integral part of a stator vane ring segment comprising radially-inner and radially-outer platforms between which the or each vane extends, it will be appreciated that other support arrangements may be provided and the arrangement of such support structures need not be described in detail. Similarly while it may be typical for a turbine blade to be supported on a rotor disc by an interlocking root (such as a fir tree root), or integrally provided on a bladed disc (a "blisk"), such that the turbine blade is integral with a radially-inner platform, it will once again be appreciated that other support arrangements may be provided, such that the support arrangement need not be described in detail.

The term spanwise extent is used herein to denote the spanwise extent of an aerodynamically functional portion of the respective component (i.e. that portion which defines an aerofoil in cross-section, which is the portion which lies between the radially-inner and radially-outer platforms between which the vane extends). Accordingly, in the context of the present disclosure, the shrouded turbine blades are considered to have a radial extent which extends beyond the respective spanwise extent, since the shroud 119 does not define an aerofoil in cross-section and defines the radially-outer platform which bounds the working flow through the turbine.

As shown in FIG. 4, the spanwise extent of the vanes 114, 124 and blades 118, 128 varies along the turbine centreline axis owing to the profiling of the radially-inner and radially-outer gas washed surfaces in an axial-radial plane. In particular, the radially-inner and radially-outer gas washed surfaces are profiled to define an expanding annular flow path in the downstream direction and the span of the vane at any particular axial location is equal to the radial extent between the respective radially-inner and radially-outer gas washed surfaces. Accordingly, the span of a vane is generally larger at its trailing edge than at its leading edge, and varies along the turbine centreline axis.

The present disclosure considers a vane to define a continuum of aerofoil sections along the span of the vane, the aerofoil section at any spanwise location being a locus of points on the surface of the vane that share a common value of normalized span. For example, the locus of points having a value of normalized span of 1 corresponds to an aerofoil section of the vane where it intersects the radially-outer platform, and the locus of points having a value of normalized span of 0.99 corresponds to an aerofoil section of the vane marginally radially inboard of the platform.

It will be appreciated that this frame of reference sensibly eliminates any possibility of referring to a truncated aerofoil section (e.g. a cross-section which has, for example, a downstream portion of an aerofoil shape, but which terminates at an upstream boundary where the cross-section intersects one of the platforms). This is not only geometrically convenient, but also functionally logical since the streamlines of the flow, particularly near the radially inner and outer boundaries of the annular flow path, will tend to follow the profile of the radially-inner and outer boundaries, such that aerofoil sections at constant normalized values of span may tend to align with semi-annular stream-surfaces (i.e. circumferentially-extending unions of like streamlines).

Figure 5:
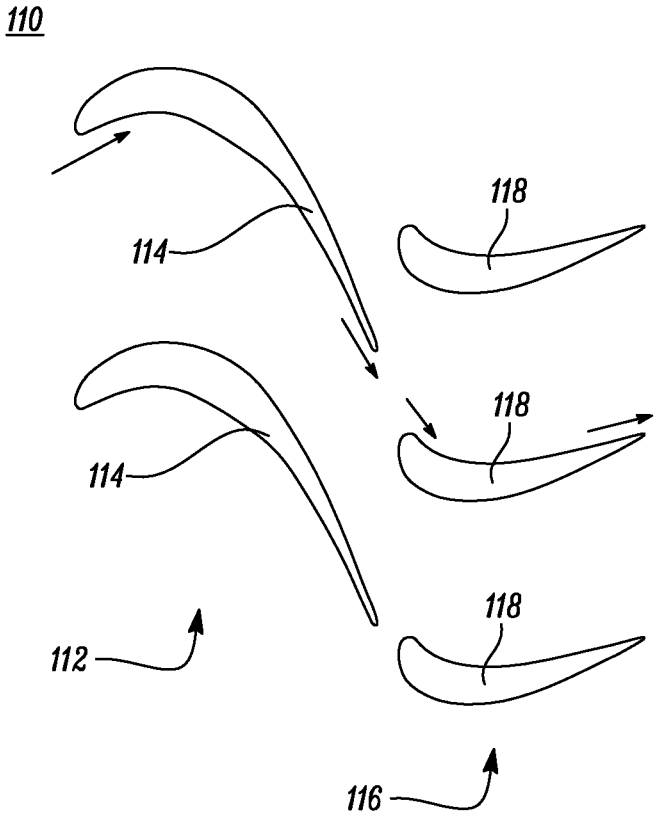
FIG. 5 is a schematic sectional view of an example turbine stage (section at a value of normalized span) of the turbine of FIG. 4.

FIG. 5 shows an exemplary arrangement of the first turbine stage 110 as shown along an axisymmetric surface about the turbine centreline axis intersecting a plurality of vanes 114 and a plurality of downstream turbine blades 118. As indicated by arrows, an annular gas flow is turned by the stator vane to drive the turbine blades. As will be appreciated by the skilled person, the flow is relatively steady at the exit of the stator vane ring, but becomes highly unsteady as it passes through the rotor ring, owing to the passing rotation of the rotor ring.

Figure 6:
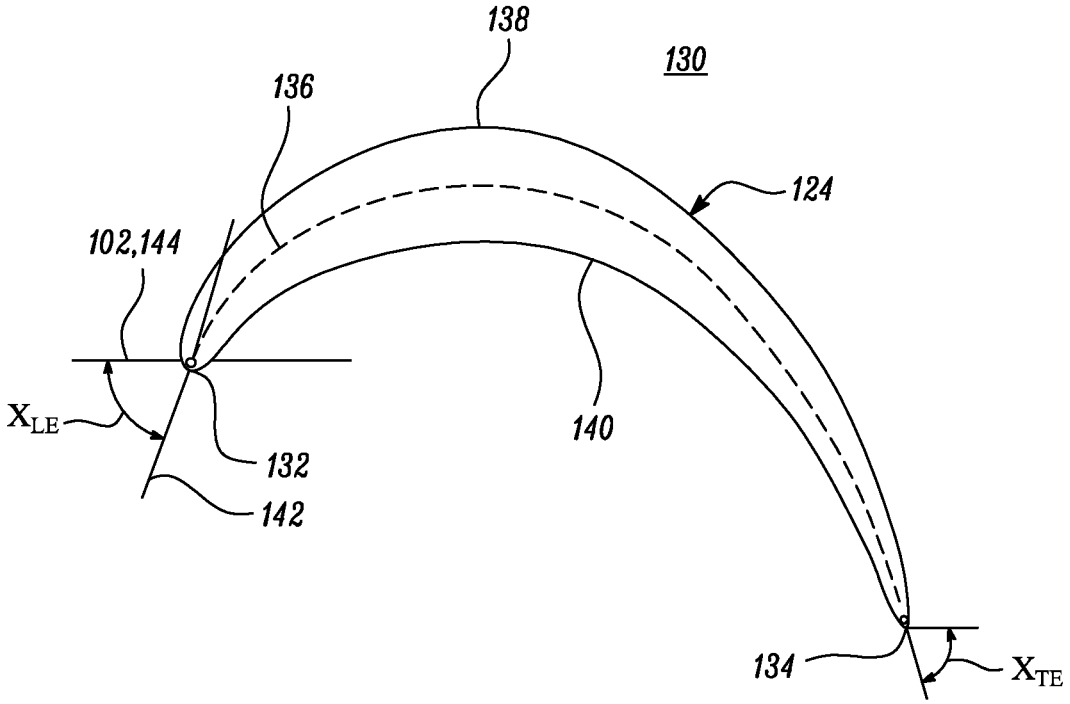
FIG. 6 is a schematic sectional view of an example stator vane (section at normalized half-span) of the example turbine stage.

FIG. 6 shows an aerofoil section 130 of a stator vane 124 as described above. As will be appreciated by the skilled person, the aerofoil section 130 as defined by values of normalized span may have an axial extent (i.e. parallel to the turbine centreline axis 102), a radial extent (i.e. parallel to a radial axis orthogonal to the turbine centreline axis 102) and a circumferential extent (i.e. around the turbine centreline axis 102).

Herein, the terms leading edge and trailing edge relate to the geometric leading edge and geometric trailing edge of a vane. The leading edge is the locus of points of maximum curvature in each respective aerofoil section towards the upstream end of the vane, and the trailing edge is the locus of points of maximum curvature in each respective aerofoil section towards the downstream end of the vane. The respective points in each aerofoil section are the leading edge point 132 and the trailing edge point 134 respectively. Where there is a curve of constant maximum curvature in any particular aerofoil section towards the upstream or downstream end of the vane, the leading edge point or the trailing edge point respectively is defined as the mid-point along that curve (i.e. the point half-way along the curve).

As shown in FIG. 6, the aerofoil section 130 defined by the locus of points having the same value of normalized span comprises a mean camber line 136. The mean camber line 136 is the locus of points midway between the suction edge 138 (corresponding to the suction surface of the vane) and the pressure edge 140 (corresponding to the pressure surface of the vane), such that the aerofoil section 130 has equal thickness either side of the mean camber line according to the American convention (i.e. measuring the thickness along directions normal to the mean camber line, rather than normal to the chord—the British convention). Like the aerofoil section 130, the mean camber line 136 may be three dimensional in that it may have an axial extent (i.e. parallel to the turbine centreline axis 102), a radial extent (i.e. parallel to a radial axis orthogonal to the turbine centreline axis 102) and a circumferential extent (i.e. around the turbine centreline axis 102). The aerofoil section 130 is axisymmetric about the turbine centreline axis (as described elsewhere herein).

The aerofoil section has a variable camber angle along the mean camber line. The camber angle at any camber line point along the mean camber line is the angle between a tangent 142 of the mean camber line at the respective camber line point and the orthogonal projection of the tangent 142 onto a plane that intersects both the turbine centreline axis 102 and the respective camber line point (i.e. along the normal of that plane). This is illustrated in FIG. 6 by reference to the leading edge point 132 as a camber line point. In particular, FIG. 6 is a view of the aerofoil section 130 along a radial direction intersecting the leading edge point 132, such that the plane of the view is orthogonal to the axially and radially-extending plane which intersects both the turbine centreline axis 102 and the leading edge point 132. Consequently, in this view the orthogonal projection 144 of the tangent of the camber line 132 appears coincident with the turbine centreline axis 102, but the skilled person will appreciate that there may be an angle between them within the respective plane. The camber angle at the leading edge is the leading edge camber angle $X_{LE}$ and the camber angle at the trailing edge is the trailing edge camber angle $X_{TE}$.

Figure 7:
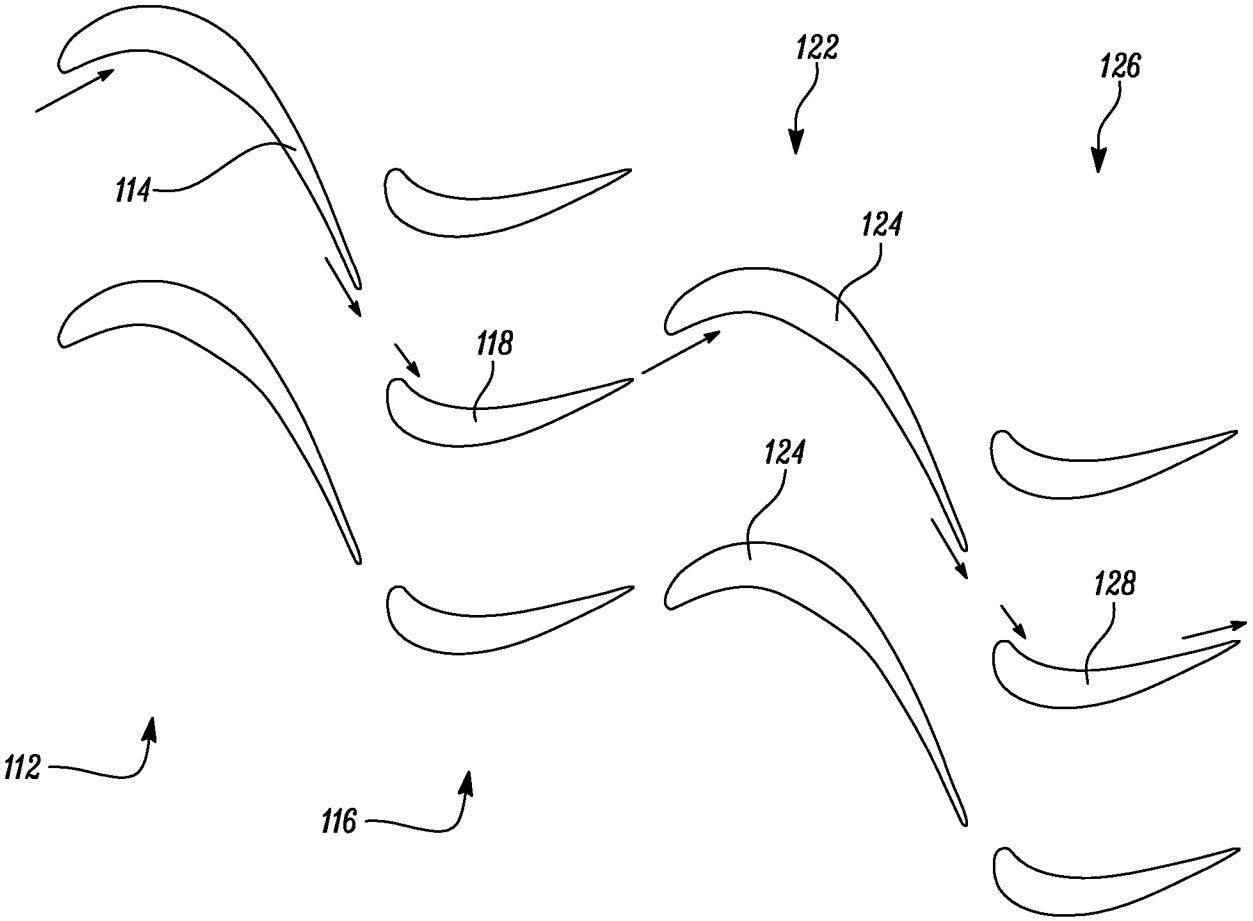
FIGS. 7 and 8 are schematic sectional views of two stages of the example turbine (sections at normalized values of span—half span and towards the tip)
Figure 8:
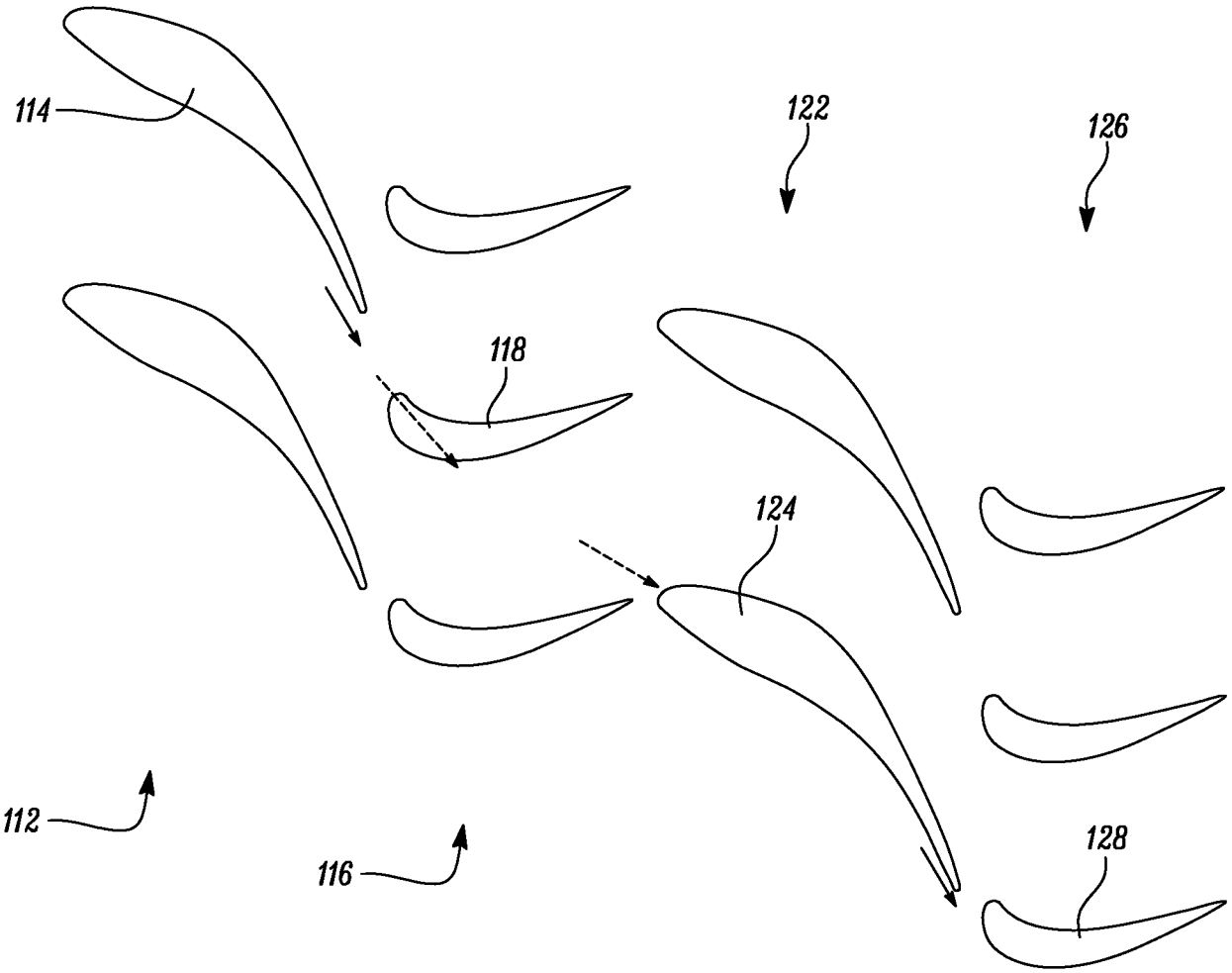

FIGS. 7 and 8 show partial cross-sectional views of the first and second turbine stages 110, 120, the respective cross-sections corresponding to an unwrapped axisymmetric surface intersecting the vanes at half-span (i.e. 0.50 span, FIG. 7) and at a spanwise location near the radially-outer gas-washed surface (e.g. 0.95 span, FIG. 8).

As will be appreciated by those skilled in the art, a flow angle (i.e. calculated in the same way as the camber angle above) of flow exiting the stator vanes 114 in the first stage 110 will closely correspond to the trailing edge camber angle $X_{TE}$.

The turbine blades 118 in the first stage 110 therefore receive flow from the upstream stator vane ring 112 at a substantially constant flow angle over a main part of the span of the blade, albeit the apparent angle in the frame of reference of the turbine blade will vary owing to the rotation of the turbine. The turbine blades 118 have the effect of turning the flow angle of a working portion of the flow which is bounded by the radially-inner surface of the shroud (the term "working" is used as this is the flow which acts to drive the turbine blades).

This working portion of the flow exiting the rotor ring 116 radially-inwardly of the shrouds 119 is highly unsteady, with the flow angle at the downstream stator vanes 124 in the second stage 120 varying significantly as the turbine blades pass in front of the stator vanes. Further, the flow angle is a function of the rotational speed of the rotor ring (and also a function of the velocity of the flow).

The inventors have determined that, while the turbine blades 118 turn this working portion of the flow and cause a highly unsteady flow at the downstream stator vane, the tip leakage flow that passes between the shroud 119 and the casing 106 is not turned in the same way. In particular, the tip leakage flow may continue at substantially the same flow angle as the exit angle from the upstream stator vane ring 112, or may be turned by a relatively lower amount (compared to turning along the span of the turbine blade) owing to friction effects within the cavity between the shroud 119 and the casing 106. Furthermore, the inventors have determined that, unlike the working portion of the flow exiting from the spanwise extent of the turbine blades (i.e. radially inwardly of the shrouds 119) which is highly unsteady, the exit angle of the tip leakage flow is substantially constant, and largely unaffected by the rotational speed of the rotor ring.

While the inventors have previously acknowledged that a flow exit angle from the upstream rotor ring differs between the working portion of the flow and the tip leakage flow, until now it has only been considered to accommodate this discrepancy by thickening the profile of a tip portion of the vane. Vane thickening is the primary method by which unsteady flow angle variation is accommodated. The inventors, having determined that the tip leakage flow is largely unturned, substantially constant and largely unaffected by the rotational speed of the upstream rotor ring, have determined that the efficiency of the turbine can be improved by defining the geometry of a stator vane downstream of such a shrouded turbine blade to reflect the difference in the flow angle of the tip leakage flow and the flow angle of the working portion of the flow, as will be described in detail below.

As shown in FIG. 7, the profile of the stator vane 124 at the half-span location is conventional in that it has relatively high curvature such that the leading edge camber angle and the trailing edge camber are of opposite sign. In particular, the sign convention for the camber angle at any spanwise location (i.e. a global coordinate system for the stator vane) is such that, at the half-span location, the camber angle increases along the mean camber line from a negative leading edge camber angle to a positive trailing edge camber angle. Accordingly, at the half-span location, the vane 124 has a relatively high turning angle, which is the difference between the trailing edge camber angle and the leading edge camber angle, the sign convention being such that the turning angle is positive at the half-span location in this example (i.e. the turning angle is calculated as $X_{TE}-X_{LE}$).

While the leading edge camber angle is negative such that the stator vane 124 may be considered to be optimised for a negative inlet flow angle, it will be appreciated that the inlet flow angle is unsteady and varies significantly as the upstream rotor ring 116 passes the stator vane 114.

In contrast, as shown in FIG. 8, the leading edge camber angle in a tip portion of the vane 124 is positive, such that in this region the vane 124 may be considered as optimised for a positive inlet flow angle corresponding to receipt of the tip leakage flow that passes over the shrouds 119 of the upstream turbine blades 118, and is not significantly turned by the rotors. In FIG. 8, the tip leakage flow over the rotor ring 116 is indicated by dashed arrows, as it will be appreciated that the tip leakage flow lies outside of the indicated cross-section.

Figure 9:
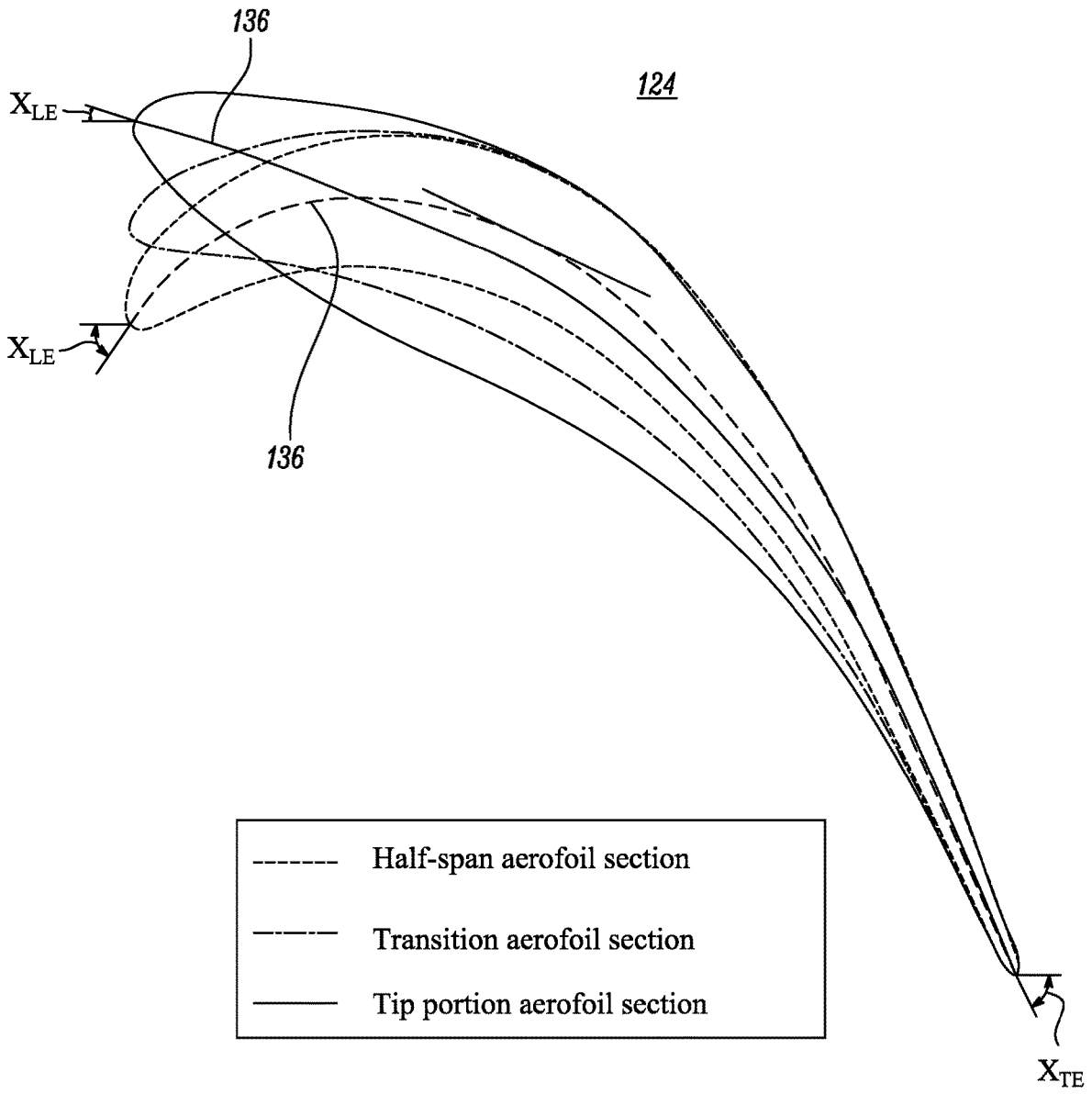
FIG. 9 is a schematic sectional view of an example stator vane of the example turbine (sections at three values of normalized span)
Figure 10:
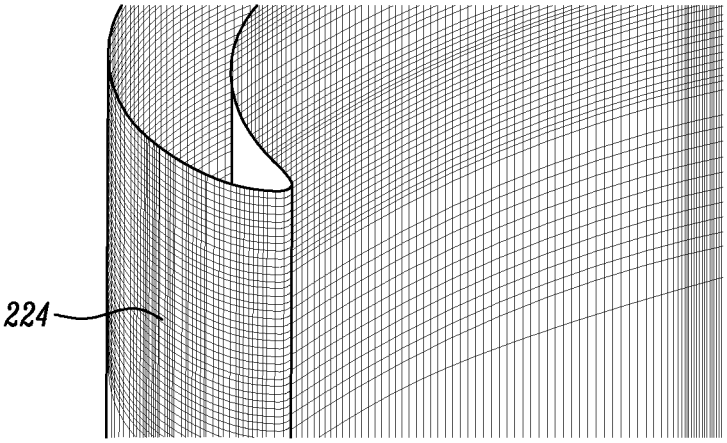
FIG. 10 is a perspective view of a datum stator vane.

FIG. 9 shows three overlaid aerofoil sections of the vane 124 at (i) the half-span location, (ii) a transition portion and (iii) a tip portion of the vane so as to better illustrate the sign and variation of the camber angle. FIG. 10 shows a three-dimensional perspective view of a datum stator vane 224 towards the tip of the vane which has a substantially constant aerofoil section from the half-span location to the tip, whereas FIG. 11 shows a corresponding view of the example stator vane 124 described above with respect to FIGS. 4-9 towards the tip of the vane.

Figure 11:
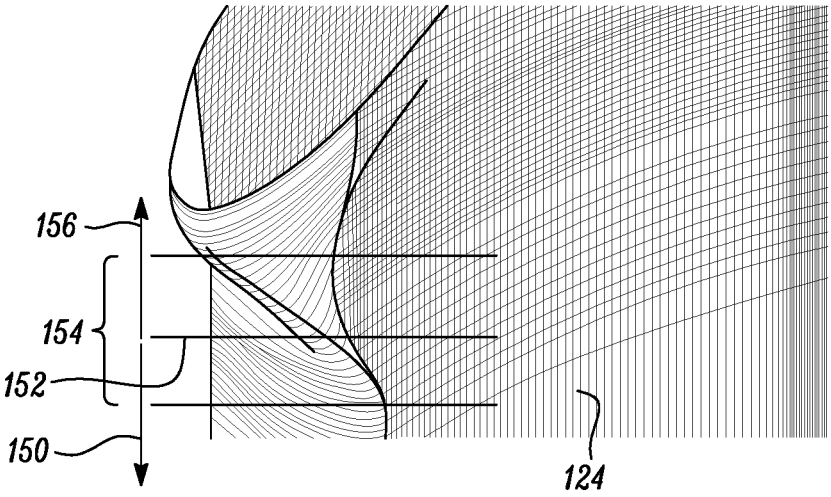
FIG. 11 is a like perspective view of the example stator vane of FIG. 9.

FIG. 11 indicates three spanwise portions of the example stator vane 124 by reference to three lines that intersect the leading edge of the vane at respective spanwise locations to indicate their relative spanwise extent. The three spanwise portions include an intermediate portion 150 which extends from the half-span location to a radially-inner boundary 152 of a tip portion 156 which extends from the boundary 152 to the extreme tip of the vane. There is also a transition portion 154 which in this example overlaps both the intermediate portion 150 and the tip portion (although in other examples, the transition portion may reside wholly within the intermediate portion).

With reference to FIGS. 9 and 11, and by comparison with FIG. 10, it can be seen that towards a radially-outer tip of the vane 124, an upstream portion of the mean camber line 136 diverges from a profile of the mean camber line at the half-span location so that within a tip portion 156 of the vane the leading edge camber angle is positive.

With reference to FIG. 11, the intermediate portion 150 reflects the spanwise extent of the vane radially outboard of the half-span location along which the aerofoil profile is substantially conventional in that each respective aerofoil section is highly curved so that the leading edge camber angle is negative and the trailing edge camber angle is positive. In the transition portion 154, the leading edge camber angle increases (relative to the leading edge camber angle at the half-span location) towards the tip of the vane, so that within the tip portion 156 the leading edge camber angle is positive.

In this first example, the spanwise extent of the tip portion is from 0.97 span to 1.0 span (such that the spanwise extent of the intermediate portion is from 0.5 span to 0.97 span), and the spanwise extent of the transition portion is from 0.92 span to 0.99 span.

Increasing the leading edge camber angle to alter the upstream profile of the vane without corresponding increase of the trailing edge camber angle has the effect of reducing the turning angle of the vane towards and within the tip portion of the vane. As explained above, the turning angle can be reduced towards the tip because the flow received at the stator vane from the upstream rotor is a tip leakage flow which has not been significantly turned since exiting the upstream stator (i.e. has not been significantly turned by the intervening rotor ring).

In this first example, at the half-span location the leading edge camber angle is −30° and the trailing edge camber angle is +65°, such that the turning angle is 95° at the half-span location.

In this example, the leading edge camber angle changes continuously within the transition portion of the vane at an average rate of approximately 7° per 0.01 span, although the rate of change is graduated at the ends of the transition portion to provide a smooth profile of the vane. Accordingly, with the transition portion commencing at 0.92 span, the leading edge camber angle becomes positive at approximately 0.97 span (noting the non-constant rate of change of the leading edge camber angle), such that the tip portion extends from 0.97 span to 1.0 span.

The rate of change of the upstream portion of the aerofoil section can alternatively be expressed by reference to the turning angle. In this first example, the trailing edge camber angle remains constant at 65° from the half-span location to the tip of the vane, and so the average 7° increase of leading edge camber angle per 0.01 span corresponds to a decrease of the turning angle of −7° per 0.01 span.

This may also be expressed as a fraction of the turning angle at the half-span location. In this particular example, the 7° increase of leading edge camber angle per 0.01 span corresponds to $0.074\times|\chi_{LTE,half\text{-}span}-\chi_{LE,half\text{-}span}|$.

In this first example, the total angular change of the leading edge camber angle within the transition portion is 50°. However, in variants of the example, the total angular change may be less, for example if the magnitude of the leading edge camber angle at the half-span location is lower, or the trailing edge camber angle is lower, such that the tip leakage flow approaches the vane at a lower angle. It may also be greater.

As will be appreciated, any of the rates of change expressed above may be adjusted to provide a shorter or longer transition portion. Further, any of the rates of change may be variable or constant within the transition portion.

For example, the rate of change of the camber angle and/or turning angle may be higher or lower, and over a longer or shorter spanwise extent. In a second example, the spanwise extent of the tip portion is from 0.9 span to 1.0 span (such that the spanwise extent of the intermediate portion is from 0.5 span to 0.9 span), and the spanwise extent of the transition portion is from 0.8 span to 0.97 span. The aerofoil section at the half span location may be as described with respect to the first example presented above. In the second example the leading edge camber angle changes continuously within the transition portion of the vane at a constant rate of 3° per 0.01 span. Accordingly, with the transition portion commencing at 0.8 span, the leading edge camber angle becomes positive at 0.9 span, such that the tip portion extends from 0.9 span to 1.0 span.

The rate of change of the upstream portion of the aerofoil section can alternatively be expressed by reference to the turning angle. In this second example, the trailing edge camber angle remains constant at 65° from the half-span location to the tip of the vane, and so the 3° increase of leading edge camber angle per 0.01 span corresponds to a decrease of the turning angle of −3° per 0.01 span.

This may also be expressed as a fraction of the turning angle at the half-span location. In this particular example, the 3° increase of leading edge camber angle per 0.01 span corresponds to $0.032\times|\chi_{half\text{-}span,TE}-\chi_{half\text{-}span,LE}|$.

The tip portion may be defined by reference to the sign change of the leading edge camber angle as above. Additionally or alternatively, it may be defined by reference to other metrics.

The tip portion may be characterised by a low turning angle. In particular, the turning angle may be 70° or less, for example 65° or less, or 60° or less. In the first example described above, the tip portion can be defined by a turning angle of 65° or less, which corresponds to the tip portion commencing at approximately 0.97 span.

The tip portion may be characterised by the turning angle being a fraction of the turning angle at the half-span location. In particular, the turning angle may be 0.75 or less of the half-span turning angle, for example 0.7 or less, 0.65 or less, or 0.6 or less. In the first example described above, the tip portion can be defined by the turning angle being approximately 0.68 or less of the half-span turning angle, which corresponds to the tip portion commencing at approximately 0.97 span.

By providing a stator vane ring comprising stator vanes as described herein so that the tip portion which receives a tip leakage flow from the upstream rotor is turned towards the oncoming flow, the efficiency of the turbine can be improved.

Figure 12:
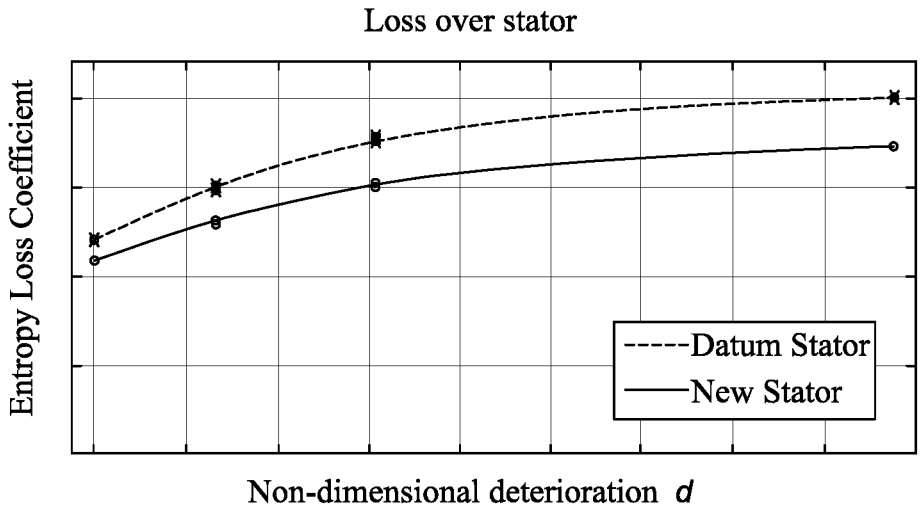
FIGS. 12 and 13 are comparative plots of entropy loss coefficient for the datum stator vane and the example stator vane o FIG. 9.
Figure 13:
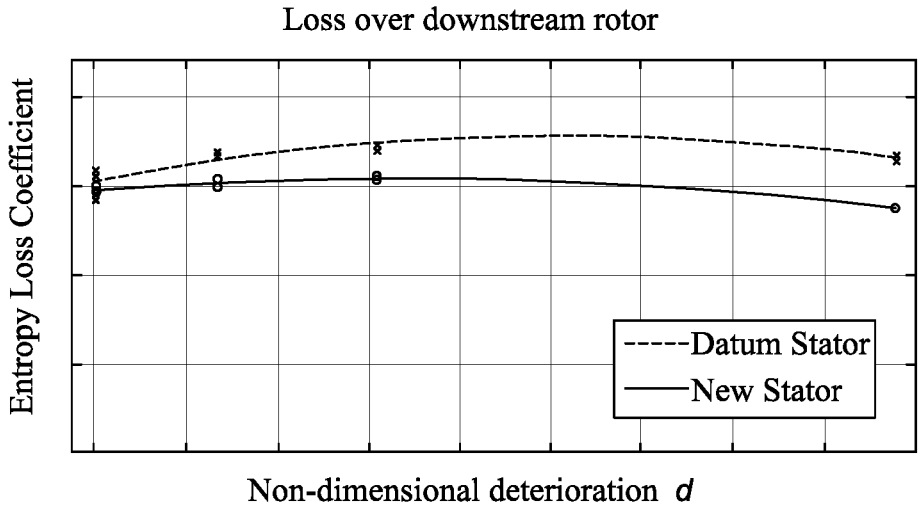

FIGS. 12 and 13 are comparative plots of entropy loss coefficients of a stator vane ring downstream of a ring of shrouded rotors, and of entropy loss coefficients of a further rotor ring downstream of the stator vane ring. The data is from testing of a low pressure turbine in which the second stator is provided as either a "datum stator" (i.e. in accordance with the example vane 224 of FIG. 10) or a "new stator" (i.e. in accordance with the first example vane 124 as described above with respect to FIGS. 4-9, 11). The datum stator and the new stator both have the same aerofoil section at the half-span location. The datum stator has a substantially constant aerofoil section from the half-span location to the tip, whereas the new stator has a divergent profile as described in accordance with the first example above. Otherwise, the turbines used for the comparison are equivalent in all respects.

The entropy loss coefficient reflects the aerodynamic performance of a respective stator ring or rotor ring, and is a standard term in the art. The x-axis of the two plots is a non-dimensional measure of the tip gap. The inventors are mindful that the tip clearance at a rotor deteriorates (increases) over time owing to abrasion of material (e.g. through heavy landings). The non-dimensional quantity d is 0 for a "new engine" with a design tip clearance, and increases to reflect the growth of the tip clearance relative to the span of the rotor.

FIGS. 12 and 13 show improved aerodynamic performance owing to installation of the new stator vanes in place of the datum stator vanes. Further, the improvement becomes more pronounced as the tip leakage flow increases (i.e. as the non-dimensional deterioration d increases, with increased d corresponding to admittance of a larger tip leakage flow).

Such improvements may be expected over a conventional operating range for a gas turbine engine, which may be characterised by a Reynold's number of greater than 50,000 (as calculated according to Equation 1 below), exit Mach relative to any respective stator vane of less than 0.95, and flow coefficient of between 0.4 to 2.0 (as calculated according to Equation 2 below.

$$Re = \frac{\rho c_x (v_x \cos \alpha_{exit})}{\mu} \quad \text{Equation 1}$$

Where ρ is density at entry to the turbine, $c_x$ is the axial chord of the respective vane, $\alpha_{exit}$ is the flow exit angle at the respective vane, and μ is the viscosity of the flow at entry to the turbine.

$$\Phi = \frac{v_x}{U} \quad \text{Equation 2}$$

Where $v_x$ is the axial flow velocity at entry to the turbine, and U is the rotational velocity of the first rotor ring of the turbine at half-span.

Stator vane rings comprising stator vanes as described herein may be assembled in any manner as known in the art. For example, stator vane ring segments may be provided, each comprising two or more stator vanes provided between semi-annular radially-inner and radially-outer platforms. A plurality of such segments may be assembled together to define a fully annular stator vane ring.

Multiple stator vane rings in a turbine may be provided with a divergent profile towards the tip as described herein. The above design is considered to be particularly appropriate to an intermediate pressure turbine and a low pressure turbine of a gas turbine engine, which conventionally have more uniform cross-sections along their span than vanes of a high pressure turbine.

Although examples of the invention have been described with reference to two exemplary turbine stages, it will be appreciated that a rotor ring immediately upstream of the first stage may comprise a shrouded rotor that permits a tip leakage flow between the rotor shroud and the casing, such that the stator vanes of the first stage also receive and a tip leakage flow and benefit from having a divergent aerofoil section towards the tip as described herein. There may be three or more such stages.

Those skilled in the art will be aware of other principles of turbine design that may lead to an aerofoil section of a stator vane differing towards the tip as compared with a profile at a half-span location. For example, it is conventional to use such design principles as "spooning" (i.e. thickening the aerofoil section towards the tip), "fillets" (more extreme thickening) and use of a contoured end-wall region (non-axisymmetric endwalls). Changing the leading edge camber angle as disclosed herein is compatible with such other design principles.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A turbine for a gas turbine engine, comprising:

a rotor ring comprising a plurality of shrouded rotor blades configured to rotate about a turbine centreline axis and to permit a tip leakage flow between respective shrouds and a casing; and a stator vane ring disposed downstream of the rotor ring so as to receive the tip leakage flow, the stator vane ring comprising a plurality of vanes;

wherein each vane of the plurality defines a continuum of aerofoil sections along a span of the vane, the aerofoil section at any spanwise location being a locus of points on a surface of the vane that share a common value of normalized span, wherein the span of the vane is variable along the turbine centreline axis;

wherein each aerofoil section defines a mean camber line extending from a leading edge point to a trailing edge point, the leading edge point being a point of maximum curvature towards an upstream end of the vane, the trailing edge point being a point of maximum curvature towards a downstream end of the vane;

wherein each aerofoil section has a variable camber angle along the mean camber line, defined for any camber line point on the mean camber line as an angle between a respective tangent of the mean camber line and an orthogonal projection of the tangent onto a plane intersecting both the turbine centreline axis and the respective camber line point, wherein the camber angle at the leading edge point is the leading edge camber angle and the camber angle at the trailing edge point is the trailing edge camber angle;

wherein each of the plurality of vanes is curved so that at a half-span location along the vane, the leading edge camber angle being measured between (i) a portion of the turbine centreline axis that extends from the leading edge point and away from the vane defining a first leading edge camber angle line and (ii) a portion of a leading edge tangent of the mean camber line at the leading edge point that extends from the leading edge point and away from the trailing edge of the vane defining a second leading edge camber line, the trailing edge camber angle being measured between (i) a portion of a line extending away from the trailing edge point parallel to the turbine centreline axis that extends from the trailing edge point and away from the leading edge of the vane defining a first trailing edge camber angle line and (ii) a portion of a trailing edge tangent of the mean camber line at the trailing edge point that extends from the trailing edge point and away from the vane defining a second trailing edge camber angle line, wherein the first leading edge camber angle line is a 0° line, wherein a first rotational direction about the leading edge point is defined in a rotational direction from the first leading edge camber angle line away from a suction side of the vane and toward a pressure side of the vane, wherein a second rotational direction about the leading edge point is rotationally opposite of the first rotational direction, wherein angles measured in the first rotational direction are negative and angles measured in the second rotational direction are positive, wherein the leading edge camber angle has a sign convention that is negative, wherein the first trailing edge camber angle is a 0° line, wherein a third rotational direction about the trailing edge point is defined as a rotational direction from the first trailing edge camber angle line toward the suction side of the vane and away from the pressure side of the vane, wherein a fourth rotational direction about the trailing edge point is rotationally opposite of the third rotational direction, wherein angles measured in the third rotational direction are negative and angles measured in the fourth rotational direction are positive, wherein the trailing edge camber angle has a sign convention that is positive, wherein the absolute value of the leading edge and trailing edge angles is less than or equal to 180°;

wherein the sign convention for the camber angle at any spanwise location along the vane is such that, at the half-span location, the camber angle increases along the mean camber line from a negative leading edge camber angle to a positive trailing edge camber angle;

wherein, towards a radially-outer tip of each vane, an upstream portion of the mean camber line diverges from a profile of the mean camber line at the half-span location so that within a tip portion of the vane the leading edge camber angle is positive; and wherein each vane comprises a spanwise transition portion along which the leading edge camber angle increases towards the tip of the vane, and wherein a rate of change of the leading edge camber angle per 0.01 span of the vane, within the transition portion, is at least 3°.

2. The turbine as claimed in claim 1, wherein in any aerofoil section within the tip portion of each vane, an angular difference between the leading edge camber angle and the trailing edge camber angle is 70° or less.

3. The turbine as claimed in claim 1, wherein in any aerofoil section within the tip portion of each vane, an angular difference between the leading edge camber angle and the trailing edge camber angle is no more than 75% of the angular difference between the leading edge camber angle and the trailing edge camber angle at the half-span location.

4. The turbine as claimed in claim 1, wherein for any aerofoil section within the tip portion of each vane, an angular difference between the respective leading edge camber angle and the leading edge camber angle at the half-span location of the respective vane is at least 30°.

5. The turbine as claimed in claim 1, wherein in each vane, the spanwise extent of the transition portion is at least 0.03 of the span of the vane, and wherein the leading edge camber angle varies continuously within with the transition portion.

6. The turbine as claimed in claim 5, wherein the rate of change of the leading edge camber angle per 0.01 span of the vane is at least 3° throughout the transition portion.

7. The turbine as claimed in claim 5, wherein the rate of change of the leading edge camber angle per 0.01 span of the vane is at least $$0.03\times|\chi_{half\text{-}span,TE}-\chi_{half\text{-}span,LE}|$$

throughout the transition portion, wherein x is the camber angle at the half-span location, and TE, LE denote the camber angle at the trailing edge and leading edge respectively.

8. The turbine as claimed in claim 1, wherein the leading edge camber angle varies by at least 30° within the transition portion.

9. The turbine as claimed in claim 1, wherein the tip portion of each vane has a spanwise extent from the tip of the vane of at least 0.01 span and no more than 0.15 span.

10. The turbine of claim 9, wherein the spanwise extent is between 0.03 span and 0.1 span.

11. The turbine as claimed in claim 1, wherein the rotor ring is one of a plurality of rotor rings of the turbine, and wherein the stator vane ring is one of a plurality of stator vane rings of the turbine, each being downstream of a respective rotor ring.

12. A gas turbine engine comprising at least a first shaft and one or more further shafts, a high pressure turbine having one or more rotor rings coupled to the first shaft, and one or more lower pressure turbines downstream of the high pressure turbine, wherein at least one of the lower pressure turbines is in accordance with claim 1 and has one or more rotor rings coupled to a respective one of the further shafts.

13. A turbine for a gas turbine engine, comprising:

a rotor ring comprising a plurality of shrouded rotor blades configured to rotate about a turbine centreline axis and to permit a tip leakage flow between respective shrouds and a casing; and a stator vane ring disposed downstream of the rotor ring so as to receive the tip leakage flow, the stator vane ring comprising a plurality of vanes;

wherein each vane of the plurality defines a continuum of aerofoil sections along a span of the vane, the aerofoil section at any spanwise location being a locus of points on a surface of the vane that share a common value of normalized span, wherein the span of the aerofoil vane is variable along the turbine centreline axis;

wherein each aerofoil section defines a mean camber line extending from a leading edge point to a trailing edge point, the leading edge point being a point of maximum curvature towards an upstream end of the vane, the trailing edge point being a point of maximum curvature towards a downstream end of the vane;

wherein each aerofoil section has a variable camber angle along the mean camber line, defined for any camber line point on the mean camber line as an angle between a respective tangent of the mean camber line and an orthogonal projection of the tangent onto a plane intersecting both the turbine centreline axis and the respective camber line point, wherein the camber angle at the leading edge point is the leading edge camber angle and the camber angle at the trailing edge point is the trailing edge camber angle;

wherein each of the plurality of vanes is curved so that at a half-span location along the vane, the leading edge camber angle being measured between (i) a portion of the turbine centreline axis that extends from the leading edge point and away from the vane defining a first leading edge camber angle line and (ii) a portion of a leading edge tangent of the mean camber line at the leading edge point that extends from the leading edge point and away from the trailing edge of the vane defining a second leading edge camber line, the trailing edge camber angle being measured between (i) a portion of a line extending away from the trailing edge point parallel to the turbine centreline axis that extends from the trailing edge point and away from the leading edge of the vane defining a first trailing edge camber angle line and (ii) a portion of a trailing edge tangent of the mean camber line at the trailing edge point that extends from the trailing edge point and away from the vane defining a second trailing edge camber angle line, wherein the first leading edge camber angle line is a 0° line, wherein a first rotational direction about the leading edge point is defined in a rotational direction from the first leading edge camber angle line away from a suction side of the vane and toward a pressure side of the vane, wherein a second rotational direction about the leading edge point is rotationally opposite of the first rotational direction, wherein angles measured in the first rotational direction are negative and angles measured in the second rotational direction are positive, wherein the leading edge camber angle has a sign convention that is negative, wherein the first trailing edge camber angle is a 0° line, wherein a third rotational direction about the trailing edge point is defined as a rotational direction from the first trailing edge camber angle line toward the suction side of the vane and away from the pressure side of the vane, wherein a fourth rotational direction about the trailing edge point is rotationally opposite of the third rotational direction, wherein angles measured in the third rotational direction are negative and angles measured in the fourth rotational direction are positive, wherein the trailing edge camber angle has a sign convention that is positive, wherein the absolute value of the leading edge and trailing edge angles is less than or equal to 180°;

wherein the sign convention for the camber angle at any spanwise location along the vane is such that, at the half-span location, the camber angle increases along the mean camber line from a negative leading edge camber angle to a positive trailing edge camber angle;

wherein, towards a radially-outer tip of each vane, an upstream portion of the mean camber line diverges from a profile of the mean camber line at the half-span location so that within a tip portion of the vane the leading edge camber angle is positive;

wherein each vane comprises a spanwise transition portion along which the leading edge camber angle increases towards the tip of the vane, and wherein a rate of change of the leading edge camber angle per 0.01 span of the vane, within the transition portion, is at least:

$$0.03\times|\chi_{half\text{-}span,TE}-\chi_{half\text{-}span,LE}|$$

wherein $\chi_{half\text{-}span}$ is the camber angle at the half-span location, and TE, LE denote the camber angle at the trailing edge and leading edge respectively.

14. A turbine for a gas turbine engine, comprising:

a rotor ring comprising a plurality of shrouded rotor blades configured to rotate about a turbine centreline axis and to permit a tip leakage flow between respective shrouds and a casing; and a stator vane ring disposed downstream of the rotor ring so as to receive the tip leakage flow, the stator vane ring comprising a plurality of vanes;

wherein each vane of the plurality defines a continuum of aerofoil sections along a span of the vane, the aerofoil section at any spanwise location being a locus of points on a surface of the vane that share a common value of normalized span, wherein the span of the vane is variable along the turbine centreline axis;

wherein each aerofoil section defines a mean camber line extending from a leading edge point to a trailing edge point, the leading edge point being a point of maximum curvature towards an upstream end of the vane, the trailing edge point being a point of maximum curvature towards a downstream end of the vane;

wherein each aerofoil section has a variable camber angle along the mean camber line, defined for any camber line point on the mean camber line as an angle between a respective tangent of the mean camber line and an orthogonal projection of the tangent onto a plane intersecting both the turbine centreline axis and the respective camber line point, wherein the camber angle at the leading edge point is the leading edge camber angle and the camber angle at the trailing edge point is the trailing edge camber angle;

wherein each of the plurality of vanes is curved so that at a half-span location along the vane, the leading edge camber angle being measured between (i) a portion of the turbine centreline axis that extends from the leading edge point and away from the vane defining a first leading edge camber angle line and (ii) a portion of a leading edge tangent of the mean camber line at the leading edge point that extends from the leading edge point and away from the trailing edge of the vane defining a second leading edge camber line, the trailing edge camber angle being measured between (i) a portion of a line extending away from the trailing edge point parallel to the turbine centreline axis that extends from the trailing edge point and away from the leading edge of the vane defining a first trailing edge camber angle line and (ii) a portion of a trailing edge tangent of the mean camber line at the trailing edge point that extends from the trailing edge point and away from the vane defining a second trailing edge camber angle line, wherein the first leading edge camber angle line is a 0° line, wherein a first rotational direction about the leading edge point is defined in a rotational direction from the first leading edge camber angle line away from a suction side of the vane and toward a pressure side of the vane, wherein a second rotational direction about the leading edge point is rotationally opposite of the first rotational direction, wherein angles measured in the first rotational direction are negative and angles measured in the second rotational direction are positive, wherein the leading edge camber angle has a sign convention that is negative, wherein the first trailing edge camber angle is a 0° line, wherein a third rotational direction about the trailing edge point is defined as a rotational direction from the first trailing edge camber angle line toward the suction side of the vane and away from the pressure side of the vane, wherein a fourth rotational direction about the trailing edge point is rotationally opposite of the third rotational direction, wherein angles measured in the third rotational direction are negative and angles measured in the fourth rotational direction are positive, wherein the trailing edge camber angle has a sign convention that is positive, wherein the absolute value of the leading edge and trailing edge angles is less than or equal to 180°;

wherein the sign convention for the camber angle at any spanwise location along the vane is such that, at the half-span location, the camber angle increases along the mean camber line from a negative leading edge camber angle to a positive trailing edge camber angle;

wherein, towards a radially-outer tip of each vane, an upstream portion of the mean camber line diverges from a profile of the mean camber line at the half-span location so that within a tip portion of the vane the leading edge camber angle is positive;

wherein each aerofoil section defines a turning angle defined as the difference between the trailing edge camber angle and the leading edge camber angle, wherein the sign convention for the turning angle is such that the turning angle is positive at the half-span location; and wherein each vane comprises a spanwise transition portion along which the turning angle reduces towards the tip of the vane, and wherein a rate of change of the turning angle per 0.01 span of the vane, towards the tip of the vane and within the transition portion, is less than −3°.

15. The turbine as claimed in claim 14, wherein the rate of change of the turning angle per 0.01 span of the vane, towards the tip of the vane and throughout the transition portion, is less than −3°.

* * * * *